US008291972B2

(12) United States Patent
Dusterhoft et al.

(10) Patent No.: US 8,291,972 B2
(45) **Date of Patent: *Oct. 23, 2012**

(54) SAND CONTROL SCREEN ASSEMBLY AND METHOD FOR USE OF SAME

(75) Inventors: Ronald G. Dusterhoft, Katy, TX (US); Kim Vance Thornton, Houston, TX (US); Carl Bismark Ferguson, La Porte, TX (US); Floyd Randolph Simonds, Dallas, TX (US); Tommy Frank Grigsby, Katy, TX (US); William Mark Richards, Frisco, TX (US); Luke William Holderman, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 251 days.

This patent is subject to a terminal disclaimer.

(21) Appl. No.: 12/888,590

(22) Filed: Sep. 23, 2010

(65) Prior Publication Data

US 2011/0011586 A1 Jan. 20, 2011

Related U.S. Application Data

(62) Division of application No. 12/201,468, filed on Aug. 29, 2008, now Pat. No. 7,814,973.

(51) Int. Cl.
*E03B 3/18* (2006.01)
*E21B 43/04* (2006.01)

(52) U.S. Cl. ..... 166/227; 166/278

(58) Field of Classification Search ..... 166/278, 166/227

See application file for complete search history.

(56) References Cited

U.S. PATENT DOCUMENTS

| | | | |
|---|---|---|---|
| 921,337 | A | 5/1909 | Archer |
| 1,811,235 | A | 6/1931 | King |
| 2,945,541 | A | 7/1960 | Maley et al. |
| 2,981,333 | A | 4/1961 | Miller et al. |
| 3,390,724 | A | 7/1968 | Caldwell |
| 4,585,064 | A | 4/1986 | Graham et al. |

(Continued)

FOREIGN PATENT DOCUMENTS

EP 1759086 3/2007

(Continued)

OTHER PUBLICATIONS

Dave Allison; Swellable Rubber Technology Joins Cementing; E&P (May 2007).

(Continued)

*Primary Examiner* — Jennifer H Gay
*Assistant Examiner* — Michael Wills, III
(74) *Attorney, Agent, or Firm* — Lawrence R. Youst

(57) ABSTRACT

A sand control screen assembly (70) is operably positionable within a wellbore (84). The sand control screen assembly (70) includes a base pipe (72) having at least one opening and an internal flow path (74). A swellable material layer (76) is disposed exteriorly of the base pipe (72). A fluid collection subassembly (78) is disposed exteriorly of the swellable material layer (76). A drainage layer (82) is disposed exteriorly of the fluid collection subassembly (78) and the swellable material layer (76). In response to contact with an activating fluid, radial expansion of the swellable material layer (76) causes at least a portion of the fluid collection subassembly (78) and the drainage layer (82) to be displaced toward a surface of the wellbore (84).

23 Claims, 15 Drawing Sheets

U.S. PATENT DOCUMENTS 4,670,501 A 6/1987 Dymond et al.
5,249,627 A 10/1993 Harms et al.
5,833,000 A 11/1998 Weaver et al.
5,836,392 A 11/1998 Urlwin-Smith
5,839,510 A 11/1998 Weaver et al.
5,853,048 A 12/1998 Weaver et al.
5,874,490 A 2/1999 Arora et al.
5,901,789 A 5/1999 Donnelly et al.
5,934,376 A 8/1999 Nguyen et al.
6,003,600 A 12/1999 Nguyen et al.
6,192,986 B1 2/2001 Urlwin-Smith
6,196,317 B1 3/2001 Hardy
6,263,966 B1 7/2001 Haut et al.
6,302,207 B1 10/2001 Nguyen et al.
6,311,773 B1 11/2001 Todd et al.
6,427,775 B1 8/2002 Dusterhoft et al.
6,439,309 B1 8/2002 Matherly et al.
6,446,722 B2 9/2002 Nguyen et al.
6,457,518 B1 10/2002 Castano-Mears et al.
6,481,494 B1 11/2002 Dusterhoft et al.
6,540,022 B2 4/2003 Dusterhoft et al.
6,543,545 B1 4/2003 Chatterji et al.
6,557,635 B2 5/2003 Nguyen et al.
6,571,872 B2 6/2003 Dusterhoft et al.
6,575,245 B2 6/2003 Hurst et al.
6,582,819 B2 6/2003 McDaniel et al.
6,588,507 B2 7/2003 Dusterhoft et al.
6,653,436 B2 11/2003 Back et al.
6,677,426 B2 1/2004 Noro et al.
6,698,519 B2 3/2004 Nguyen et al.
6,702,019 B2 3/2004 Dusterhoft et al.
6,719,051 B2 4/2004 Hailey et al.
6,755,245 B2 6/2004 Nguyen et al.
6,766,862 B2 7/2004 Chatterji et al.
6,772,837 B2 8/2004 Dusterhoft et al.
6,854,522 B2 2/2005 Brezinski et al.
6,886,634 B2 5/2005 Richards
6,899,176 B2 5/2005 Hailey et al.
6,956,086 B2 10/2005 Back et al.
7,013,979 B2 3/2006 Richard
7,036,587 B2 5/2006 Munoz et al.
7,096,945 B2 8/2006 Richards et al.
7,100,686 B2 9/2006 Wittrisch
7,108,062 B2 9/2006 Castano-Mears et al.
7,108,083 B2 9/2006 Simonds et al.
7,114,560 B2 10/2006 Nguyen et al.
7,131,491 B2 11/2006 Blauch et al.
7,153,575 B2 12/2006 Anderson et al.
7,191,833 B2 3/2007 Richards
7,204,316 B2 * 4/2007 Dusterhoft et al. ..... 166/381
7,216,706 B2 5/2007 Echols et al.
7,252,142 B2 8/2007 Brezinski et al.
7,258,166 B2 8/2007 Russell
7,264,047 B2 9/2007 Brezinski et al.
7,267,171 B2 9/2007 Dusterhoft et al.
7,284,603 B2 10/2007 Ohmer
7,299,875 B2 11/2007 Nguyen et al.
7,299,882 B2 11/2007 Brezinski et al.
7,320,367 B2 1/2008 Brezinski et al.
7,350,579 B2 4/2008 Gatlin et al.
7,363,986 B2 4/2008 Brezinski et al.
7,373,991 B2 5/2008 Vaidya et al.
7,387,165 B2 6/2008 Lopez de Cardenas et al.
7,392,847 B2 7/2008 Gatlin et al.
7,401,648 B2 7/2008 Richard
7,404,437 B2 7/2008 Brezinski et al.
7,413,022 B2 8/2008 Broome et al.
7,426,962 B2 9/2008 Moen et al.
7,431,098 B2 10/2008 Ohmer et al.
7,451,815 B2 11/2008 Hailey
7,469,743 B2 12/2008 Richards
7,493,947 B2 2/2009 Ross
7,511,487 B2 3/2009 Badry et al.
7,520,327 B2 4/2009 Surjaatmadja
7,604,055 B2 10/2009 Richard
7,673,678 B2 3/2010 MacDougal et al.
7,687,571 B2 3/2010 Vaidya et al.
7,703,520 B2 4/2010 Dusterhoft
7,712,529 B2 5/2010 Dusterhoft et al.
7,762,344 B2 7/2010 Courville et al.
7,814,973 B2 10/2010 Dusterhoft et al.
7,828,068 B2 11/2010 Gano
7,841,409 B2 11/2010 Gano et al.
7,849,930 B2 12/2010 Chalker et al.
7,866,383 B2 1/2011 Dusterhoft et al.
2002/0020527 A1 2/2002 Kilaas et al.
2004/0060695 A1 4/2004 Castano-Mears et al.
2004/0134656 A1 7/2004 Richards
2005/0126776 A1 6/2005 Russell
2006/0042801 A1 3/2006 Hackworth et al.
2006/0108114 A1 5/2006 Johnson
2006/0185849 A1 8/2006 Edwards et al.
2006/0186601 A1 8/2006 Lopez
2007/0012436 A1 1/2007 Freyer
2007/0114018 A1 5/2007 Brezinski et al.
2007/0257405 A1 11/2007 Freyer
2007/0272411 A1 11/2007 Lopez de Cardenas et al.
2008/0006405 A1 1/2008 Rickman et al.
2008/0149346 A1 6/2008 Bosma et al.
2008/0149351 A1 6/2008 Marya et al.
2008/0217002 A1 9/2008 Simonds et al.
2008/0283240 A1 11/2008 Baaijens et al.
2009/0173490 A1 7/2009 Dusterhoft et al.

FOREIGN PATENT DOCUMENTS

GB 2421527 6/2006
WO 9626350 8/1996
WO 03052238 6/2003
WO 2004018836 3/2004
WO 2004022911 3/2004
WO 2005056977 6/2005
WO 2005100743 10/2005
WO 2005124091 12/2005
WO 2006003112 1/2006
WO 2006003113 1/2006
WO 2006113500 10/2006
WO 2007092082 8/2007
WO 2007092083 8/2007
WO 2007126496 11/2007
WO 2008070674 6/2008
WO 2008122809 10/2008
WO 2009001073 12/2008

OTHER PUBLICATIONS

Drew Hembling; Aramco Uses Swell Packers to Enable Smart Open-Hole, Multilateral Completions for EOR; Completions (Sep./Oct. 2007); (pp. 108-114).
Cleanable Media Products; http://www.purloator-facet.com/media.htm; (Nov. 27, 2007); (pp. 1-3).
Karen Bybee; Swelling Packers Solve Zonal-Isolation Challenge in Oman High-Pressure Wells; HP/HT hallenges article; (Mar. 2007); (pp. 75-79).
Teleperf Technology ; Baker Hughes Incorporated; (pp. 1-3) (Undated but admitted prior art).
International Search Report and Written Opinion, International Searching Authority European Patent Office, Aug. 5, 2009.
PCT Search Report and Written Opinion—PCT/US2009/054957, International Searching Authority, Dec. 12, 2009.

* cited by examiner

SAND CONTROL SCREEN ASSEMBLY AND METHOD FOR USE OF SAME

CROSS-REFERENCE TO RELATED APPLICATIONS

This is a divisional application of co-pending application Ser. No. 12/201,468, entitled Sand Control Screen Assembly and Method for Use of Same, filed Aug. 29, 2008.

TECHNICAL FIELD OF THE INVENTION

This invention relates, in general, to controlling the production of particulate materials from a subterranean formation and, in particular, to a sand control screen assembly having a swellable material layer that is operable to radially expand downhole in response to contact with an activating fluid.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate materials. For example, the particulate materials cause abrasive wear to components within the well, such as tubing, flow control devices and safety devices. In addition, the particulate materials may partially or fully clog the well creating the need for an expensive workover. Also, if the particulate materials are produced to the surface, they must be removed from the hydrocarbon fluids by processing equipment at the surface.

One method for preventing the production of such particulate materials is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material, such as gravel, is then pumped down the work string and into the well annulus formed between the sand control screen and the perforated well casing or open hole production zone.

The liquid carrier either flows into the formation, returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in extended or deviated wellbores including wellbores having long, horizontal production intervals. These incomplete packs are commonly a result of the liquid carrier entering a permeable portion of the production interval causing the gravel to dehydrate and form a sand bridge in the annulus. Thereafter, the sand bridge prevents the slurry from flowing to the remainder of the annulus which, in turn, prevents the placement of sufficient gravel in the remainder of the production interval.

In addition, it has been found that gravel packing is not feasible in certain open hole completions. Attempts have been made to use expandable metal sand control screens in such open hole completions. These expandable metal sand control screens are typically installed in the wellbore then radially expanded using a hydraulic swage or cone that passes through the interior of the screen or other metal forming techniques. In addition to filtering particulate materials out of the formation fluids, one benefit of these expandable sand control screens is the radial support they provide to the formation which helps prevent formation collapse. It has been found, however, that conventional expandable sand control screens do not contact the wall of the wellbore along their entire length as the wellbore profile is not uniform. More specifically, due to the process of drilling the wellbore and heterogeneity of the downhole strata, washouts or other irregularities commonly occur which result in certain locations within the wellbore having larger diameters than other areas or having non circular cross sections. Thus, when the expandable sand control screens are expanded, voids are created between the expandable sand control screens and the irregular areas of the wellbore, which has resulted in incomplete contact between the expandable sand control screens and the wellbore. In addition, with certain conventional expandable sand control screens, the threaded connections are not expandable which creates a very complex profile, at least a portion of which does not contact the wellbore. Further, when conventional expandable sand control screens are expanded, the radial strength of the expanded screens is drastically reduced resulting in little, if any, radial support to the borehole.

Therefore, a need has arisen for a sand control screen assembly that prevents the production of particulate materials from a well that traverses a hydrocarbon bearing subterranean formation without the need for performing a gravel packing operation. A need has also arisen for such a sand control screen assembly that interventionlessly provides radial support to the formation without the need for expanding metal tubulars. Further, a need has arisen for such a sand control screen assembly that is suitable for operation in long, horizontal, open hole completions.

SUMMARY OF THE INVENTION

The present invention disclosed herein comprises a sand control screen assembly that prevents the production of particulate materials from a well that traverses a hydrocarbon bearing subterranean formation or operates as an injection well. The sand control screen assembly of the present invention achieves this result without the need for performing a gravel packing operation. In addition, the sand control screen assembly of the present invention interventionlessly provides radial support to the formation without the need for expanding metal tubulars. Further, the sand control screen assembly of the present invention is suitable for operation in open hole completions in long, horizontal production intervals.

In one aspect, the present invention is directed to a sand control screen assembly that is operable to be positioned within a wellbore. The sand control screen assembly includes a base pipe having at least one opening in a sidewall portion thereof and an internal flow path. A swellable material layer is disposed exteriorly of at least a portion of the base pipe. A fluid collection subassembly is disposed exteriorly of the swellable material layer and is in fluid communication with the internal flow path via the opening. A drainage layer is disposed exteriorly of the fluid collection subassembly and the swellable material layer such that, in response to contact with an activating fluid, radial expansion of the swellable material layer causes at least a portion of the fluid collection subassembly and the drainage layer to be displaced toward a surface of the wellbore.

In one embodiment, the swellable material layer is disposed exteriorly of a blank pipe section of the base pipe. In another embodiment, the fluid collection subassembly includes a plurality of circumferentially distributed perforated tubulars. In some embodiments, a filter medium is operably associated with the sand control screen assembly and is disposed in a fluid path between the exterior of the sand control screen assembly and the internal flow path. For example, the filter medium may be disposed internal to the fluid collection subassembly or the filter medium may be disposed downstream of the fluid collection subassembly.

Preferably, the activating fluid is at least one of a hydrocarbon fluid, water and gas. In certain embodiments, radial expansion of the swellable material layer causes at least a portion of the drainage layer to contact the wellbore. In these embodiments, the drainage layer provides a stand off region between the fluid collection subassembly and the wellbore. In one embodiment, the drainage layer is formed from a plurality of circumferential drainage layer segments. In some embodiments, an additive is carried within the drainage layer. For example, the additive may be a reactive substance such as a degradable polymer selected from the group consisting of polysaccharides, dextran, cellulose, chitins, chitosans, proteins, aliphatic polyesters, poly(lactides), poly(glycolides), poly(ε-caprolactones), poly(anhydrides), poly(hydroxybutyrates), aliphatic polycarbonates, poly(orthoesters), poly (amino acids), poly(ethylene oxides) and polyphosphazenes. In other embodiments, the additive may be selected from the group consisting of aliphatic polyesters, poly(lactides), poly (lactic acids) and poly(anhydrides).

In another aspect, the present invention is directed to a method of installing a sand control screen assembly in a wellbore. The method includes running the sand control screen assembly to a target location within the wellbore, the sand control screen assembly having a base pipe, a swellable material layer disposed exteriorly of at least a portion of a base pipe, a fluid collection subassembly disposed exteriorly of the swellable material layer and a drainage layer disposed exteriorly of the fluid collection subassembly and the swellable material layer; contacting the swellable material layer with an activating fluid; radially expanding the swellable material layer in response to contact with the activating fluid; and displacing at least a portion of the fluid collection subassembly and the drainage layer toward a surface of the wellbore in response to the radial expansion of the swellable material layer.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1A:
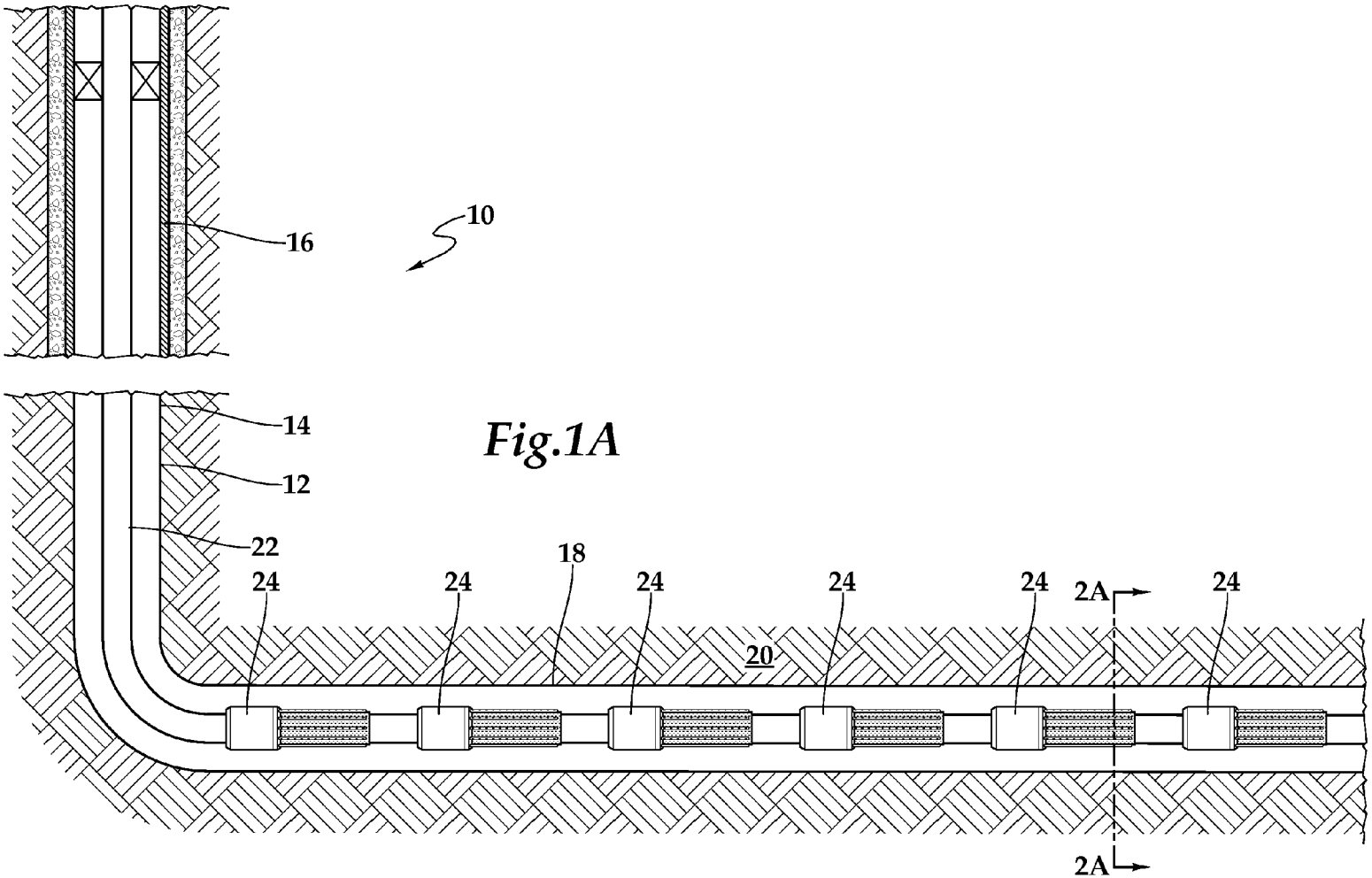
FIG. 1A is a schematic illustration of a well system operating a plurality of sand control screen assemblies in their running configuration according to an embodiment of the present invention.

Referring initially to FIG. 1A, therein is depicted a well system including a plurality of sand control screen assemblies embodying principles of the present invention that is schematically illustrated and generally designated 10. In the illustrated embodiment, a wellbore 12 extends through the various earth strata. Wellbore 12 has a substantially vertical section 14, the upper portion of which has installed therein a casing string 16 that is cemented within wellbore 12. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. Positioned within tubing string 22 is a plurality of sand control screen assemblies 24. The sand control screen assemblies 24 are shown in a running or unextended configuration.

Figure 1B:
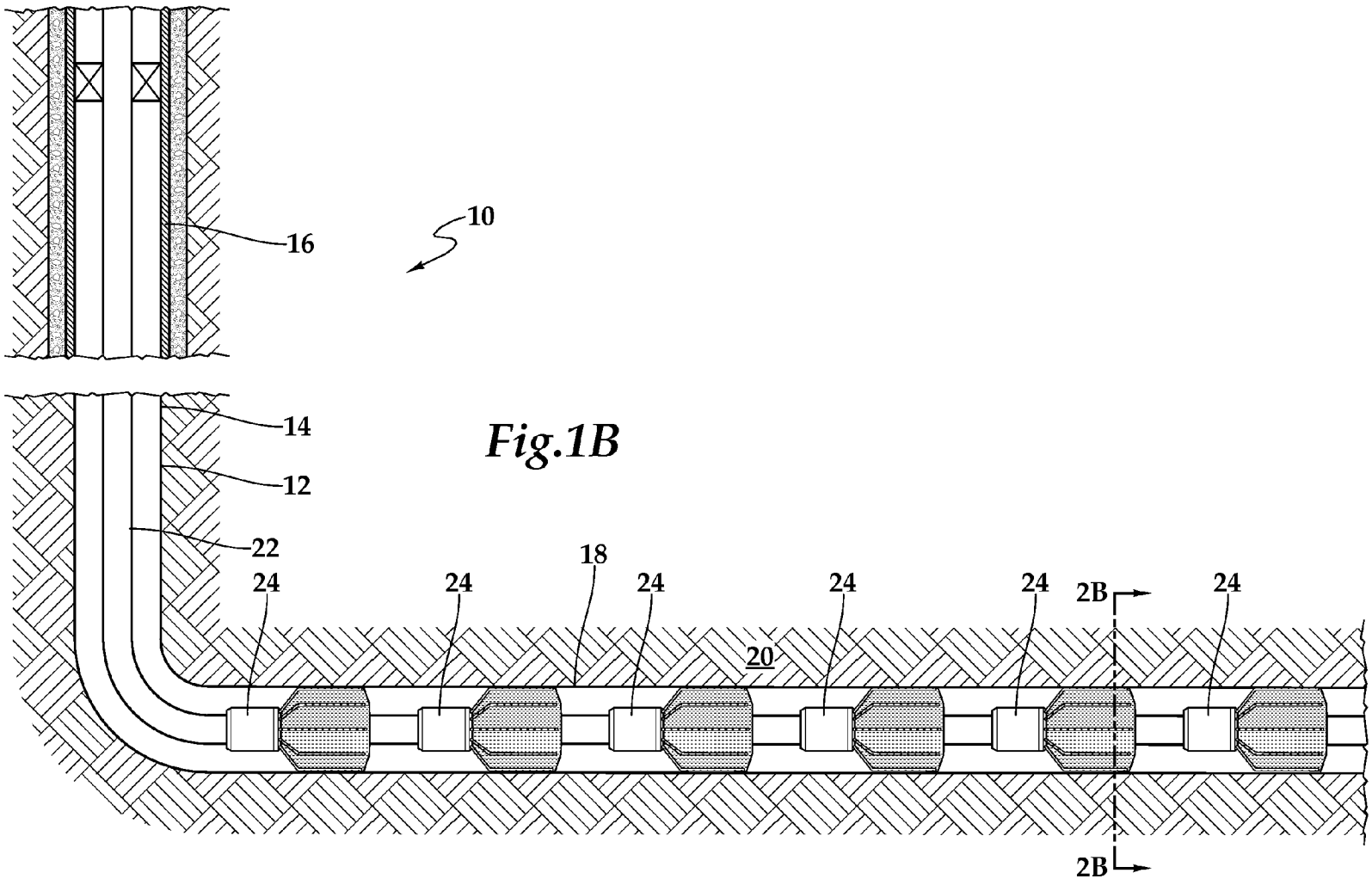
FIG. 1B is a schematic illustration of a well system operating a plurality of sand control screen assemblies in their operating configuration according to an embodiment of the present invention.

Referring also to FIG. 1B, therein is depicted the well system of FIG. 1A with sand control screen assemblies 24 in their operating or radially expanded configuration. As explained in greater detail below, each of the depicted sand control screen assemblies 24 has a base pipe, a fluid collection subassembly, a filter medium and a swellable material layer. In general, the swellable material layer is disposed exteriorly around the circumference of a blank pipe section of the base pipe and the fluid collection subassembly is disposed exteriorly of the swellable material layer. The filter medium may be disposed externally of the fluid collection subassembly, internally of the fluid collection subassembly, downstream of the fluid collection subassembly or any combination thereof. In this configuration, when sand control screen assemblies 24 come in contact with an activating fluid, such as a hydrocarbon fluid, water or a gas, the swellable material layer of each sand control screen assembly 24 radially expands which in turn causes the fluid collection subassembly of each sand control screen assemblies 24 to contact the surface of wellbore 12.

Even though FIGS. 1A-1B, depict tubing string 22 as including only sand control screen assemblies 24, those skilled in the art will recognize that tubing string 22 may include any number of other tools and systems such as fluid flow control devices, communication systems, safety systems and the like. Also, tubing string 22 may be divided into a plurality of intervals using zonal isolation devices such as packers. Similar to the swellable material in sand control screen assemblies 24, these zonal isolation devices may be made from materials that swell upon contact with a fluid, such as an inorganic or organic fluid. Some exemplary fluids that may cause the zonal isolation devices to swell and isolate include water, gas and hydrocarbons.

In addition, even though FIGS. 1A-1B depict the sand control screen assemblies of the present invention in a horizontal section of the wellbore, it should be understood by those skilled in the art that the sand control screen assemblies of the present invention are equally well suited for use in deviated or vertical wellbores. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Likewise, even though FIGS. 1A-1B depict the sand control screen assemblies of the present invention in a wellbore having a single borehole, it should be understood by those skilled in the art that the sand control screen assemblies of the present invention are equally well suited for use in multilateral wellbores having a main wellbore and a plurality of branch wellbores.

Figure 2A:
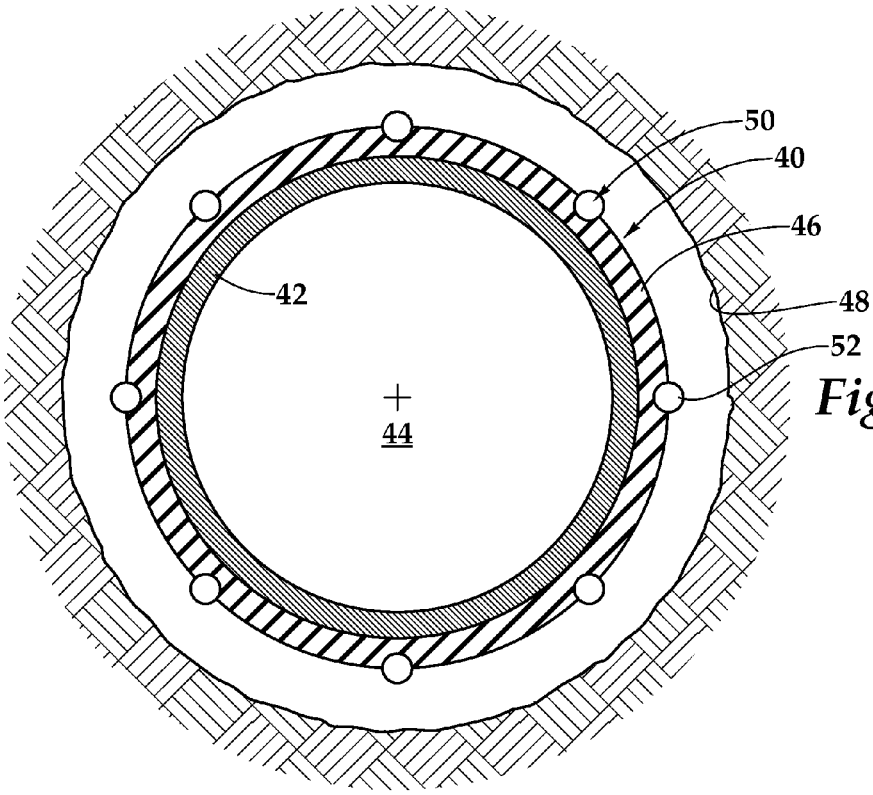
FIG. 2A is a cross sectional view taken along line 2A-2A of a sand control screen assembly of FIG. 1A in a running configuration according to an embodiment of the present invention.

Referring to FIG. 2A, therein is depicted a cross sectional view of a sand control screen assembly in its running configuration that embodies principles of the present invention and is generally designated 40. Sand control screen assembly 40 includes base pipe 42 that defines an internal flow path 44. Base pipe 42 has a plurality of openings (not pictured in this cross section) that allow fluid to pass between the exterior of base pipe 42 and internal flow path 44. Positioned around base pipe 42 is a swellable material layer 46. Swellable material layer 46 is attached to base pipe 42 by bonding or other suitable technique. Preferably, the thickness of swellable material layer 46 is optimized based upon the diameter of sand control screen assembly 40 and the diameter of wellbore 48 such that upon expansion, as explained in greater detail below, substantially uniform contact between both swellable material layer 46 and a fluid collection subassembly 50 with the surface of wellbore 48 is achieved.

Figure 3:
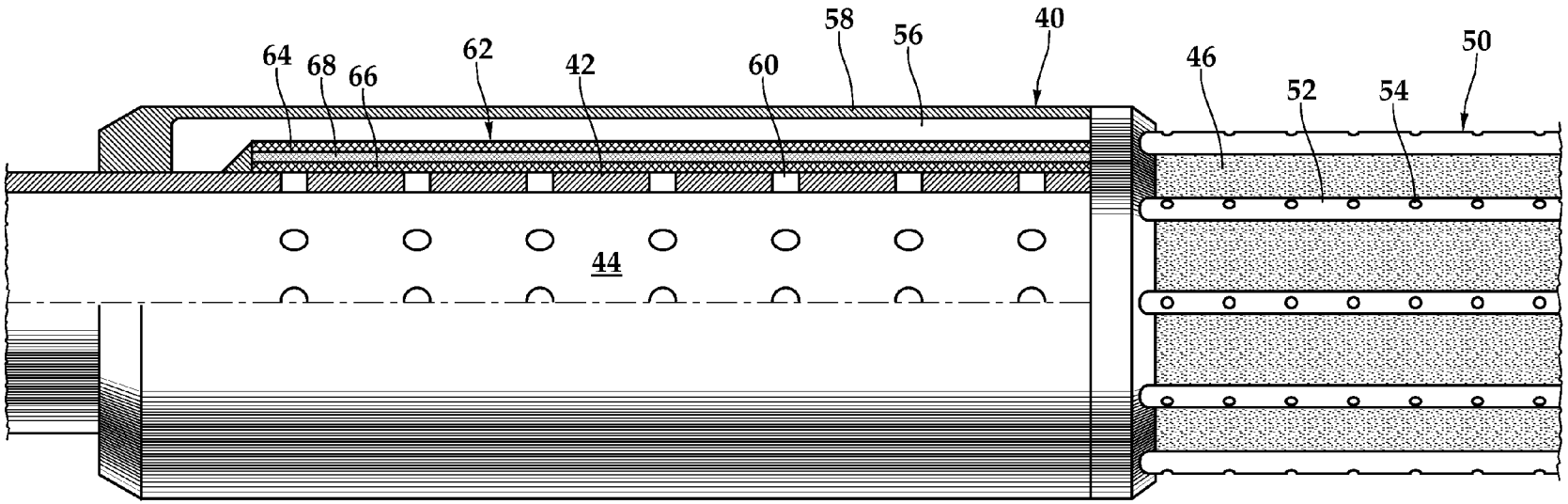
FIG. 3 is a side view partially in quarter section of a sand control screen assembly according to an embodiment of the present invention.

In the illustrated embodiment and as best seen in FIG. 3, fluid collection subassembly 50 includes a plurality of perforated tubulars 52. Preferably, perforated tubulars 52 are circumferentially distributed about the portion of sand control screen assembly 40 that includes swellable material layer 46. In operation, production fluids enter fluid collection subassembly 50 via openings 54 of perforated tubulars 52 and are discharged into annular region 56 between base pipe 42 and outer housing 58. Even though perforated tubulars 52 have been depicted as having a circular cross section, it should be understood by those skilled in the art that perforated tubulars 52 could alternatively have cross sections of different shapes including ovals, triangles, rectangles and the like as well as non symmetric cross sections.

Base pipe 42 includes a plurality of openings 60 that allow production fluids to enter internal flow path 44. Disposed around this portion of base pipe 42 and within annular region 56 is a filter medium 62. Filter medium 62 may comprise a mechanical screening element such as a fluid-porous, particulate restricting, metal screen having one or more layers of woven wire or fiber mesh that may be diffusion bonded or sintered together to form a screen designed to allow fluid flow therethrough but prevent the flow of particulate materials of a predetermined size from passing therethrough. In the illustrated embodiment, filter medium 62 includes outer and inner drainage layers 64, 66 that have a relatively course wire mesh with a filtration layer 68 disposed therebetween having a relatively fine mesh. It should be noted that other types of filter media may be used with the sand control screen assemblies of the present invention, such as a wire wrapped screen, a prepack screen, a ceramic screen, metallic beads such as stainless steel beads or sintered stainless steel beads and the like. Filter medium 62 is sized according to the particular requirements of the production zone into which it will be installed. Some exemplary sizes of the gaps in filter medium 62 may be in the 20-250 standard mesh range.

Figure 2B:
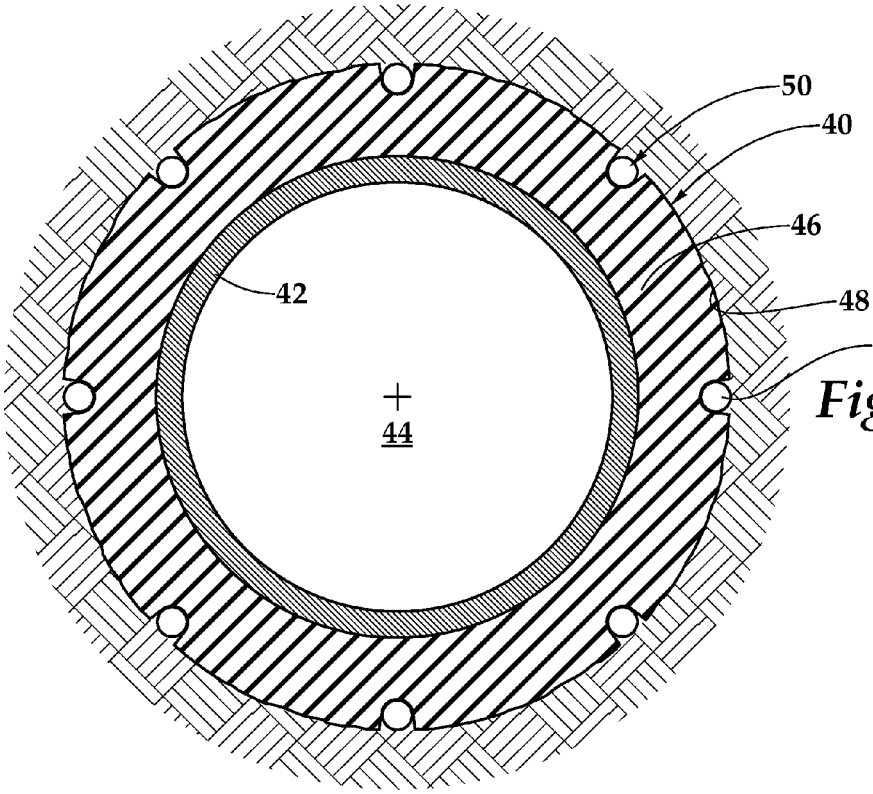
FIG. 2B is a cross sectional view taken along line 2B-2B of a sand control screen assembly of FIG. 1B in an operating configuration according to an embodiment of the present invention.

Referring additionally now to FIG. 2B, therein is depicted a cross sectional view of sand control screen assembly 40 in its operating configuration. In the illustrated embodiment, swellable material layer 46 has come in contact with an activating fluid, such as a hydrocarbon fluid, water or gas, which has caused swellable material layer 46 to radially expand into contact with the surface of wellbore 48, which, in the illustrated embodiment, is the formation face. In addition, the radial expansion of swellable material layer 46 has caused perforated tubulars 52 of fluid collection subassembly 50 to come into contact with the surface of wellbore 48. One benefit provided by the sand control screen assemblies of the present invention is that in addition to providing a path for formation fluids to enter internal flow path 44 and filtering particulate materials out of the formation fluids, the sand control screen assemblies of the present invention also provide support to the formation to prevent formation collapse. Compared with convention expandable metal sand control screens as discussed above, the sand control screen assemblies of the present invention provide improved contact with the formation as greater radial expansion is achievable and the swellable material layer is more compliant such that it is better able to conform to a nonuniform wellbore face. In a preferred implementation, the sand control screen assemblies of the present invention provide between about 500 psi and 2000 psi of collapse support to the wellbore. Those skilled in the art will recognize that the collapse support provided by the present invention can be optimized for a particular implementation though specific design features of the base pipe, the swellable material layer and the fluid collection subassembly.

Various techniques may be used for contacting swellable material layer 46 with an appropriate activating fluid for causing swelling of swellable material layer 46. For example, the activating fluid may already be present in the well when sand control screen assembly 40 is installed in the well, in which case swellable material layer 46 preferably includes a mechanism for delaying the swelling of swellable material layer 46 such as an absorption delaying or preventing coating or membrane, swelling delayed material compositions or the like.

Alternatively, the activating fluid may be circulated through the well to swellable material layer 46 after sand control screen assembly 40 is installed in the well. As another alternative, the activating fluid may be produced into the wellbore from the formation surrounding the wellbore. Thus, it will be appreciated that any method may be used for causing swelling of swellable material layer 46 of sand control screen assembly 40 in keeping with the principles of the invention.

Swellable material layer 46 is formed from one or more materials that swell when contacted by an activation fluid, such as an inorganic or organic fluid. For example, the material may be a polymer that swells multiple times its initial size upon activation by an activation fluid that stimulates the material to expand. In one embodiment, the swellable material is a material that swells upon contact with and/or absorption of a hydrocarbon, such as an oil or a gas. The hydrocarbon is absorbed into the swellable material such that the volume of the swellable material increases, creating radial expansion of the swellable material. Preferably, the swellable material will swell until its outer surface and perforated tubulars 52 of fluid collection subassembly 50 contact the formation face in an open hole completion or the casing wall in a cased wellbore. The swellable material accordingly provides the energy to position perforated tubulars 52 of fluid collection subassembly 50 in contact with the formation.

Some exemplary swellable materials include elastic polymers, such as EPDM rubber, styrene butadiene, natural rubber, ethylene propylene monomer rubber, ethylene propylene diene monomer rubber, ethylene vinyl acetate rubber, hydrogenized acrylonitrile butadiene rubber, acrylonitrile butadiene rubber, isoprene rubber, chloroprene rubber and polynorbornene. These and other swellable materials swell in contact with and by absorption of hydrocarbons so that the swellable materials expand. In one embodiment, the rubber of the swellable materials may also have other materials dissolved in or in mechanical mixture therewith, such as fibers of cellulose. Additional options may be rubber in mechanical mixture with polyvinyl chloride, methyl methacrylate, acrylonitrile, ethylacetate or other polymers that expand in contact with oil.

In another embodiment, the swellable material is a material that swells upon contact with water. In this case, the swellable material may be a water-swellable polymer such as a water-swellable elastomer or water-swellable rubber. More specifically, the swellable material may be a water-swellable hydrophobic polymer or water-swellable hydrophobic copolymer and preferably a water-swellable hydrophobic porous copolymer. Other polymers useful in accordance with the present invention can be prepared from a variety of hydrophilic monomers and hydrophobically modified hydrophilic monomers. Examples of particularly suitable hydrophilic monomers which can be utilized include, but are not limited to, acrylamide, 2-acrylamido-2-methyl propane sulfonic acid, N,N-dimethylacrylamide, vinyl pyrrolidone, dimethylaminoethyl methacrylate, acrylic acid, trimethylammoniumethyl methacrylate chloride, dimethylaminopropylmethacrylamide, methacrylamide and hydroxyethyl acrylate.

A variety of hydrophobically modified hydrophilic monomers can also be utilized to form the polymers useful in accordance with this invention. Particularly suitable hydrophobically modified hydrophilic monomers include, but are not limited to, alkyl acrylates, alkyl methacrylates, alkyl acrylamides and alkyl methacrylamides wherein the alkyl radicals have from about 4 to about 22 carbon atoms, alkyl dimethylammoniumethyl methacrylate bromide, alkyl dimethylammoniumethyl methacrylate chloride and alkyl dimethylammoniumethyl methacrylate iodide wherein the alkyl radicals have from about 4 to about 22 carbon atoms and alkyl dimethylammonium-propylmethacrylamide bromide, alkyl dimethylammonium propylmethacrylamide chloride and alkyl dimethylammonium-propylmethacrylamide iodide wherein the alkyl groups have from about 4 to about 22 carbon atoms.

Polymers which are useful in accordance with the present invention can be prepared by polymerizing any one or more of the described hydrophilic monomers with any one or more of the described hydrophobically modified hydrophilic monomers. The polymerization reaction can be performed in various ways that are known to those skilled in the art, such as those described in U.S. Pat. No. 6,476,169 which is hereby incorporated by reference for all purposes.

Suitable polymers may have estimated molecular weights in the range of from about 100,000 to about 10,000,000 and preferably in the range of from about 250,000 to about 3,000,000 and may have mole ratios of the hydrophilic monomer(s)

to the hydrophobically modified hydrophilic monomer(s) in the range of from about 99.98:0.02 to about 90:10.

Other polymers useful in accordance with the present invention include hydrophobically modified polymers, hydrophobically modified water-soluble polymers and hydrophobically modified copolymers thereof. Particularly suitable hydrophobically modified polymers include, but are not limited to, hydrophobically modified polydimethylaminoethyl methacrylate, hydrophobically modified polyacrylamide and hydrophobically modified copolymers of dimethylaminoethyl methacrylate and vinyl pyrollidone.

As another example, the swellable material may be a salt polymer such as polyacrylamide or modified crosslinked poly (meth)acrylate that has the tendency to attract water from salt water through osmosis wherein water flows from an area of low salt concentration, the formation water, to an area of high salt concentration, the salt polymer, across a semi permeable membrane, the interface between the polymer and the production fluids, that allows water molecules to pass therethrough but prevents the passage of dissolved salts therethrough.

Figure 4A:
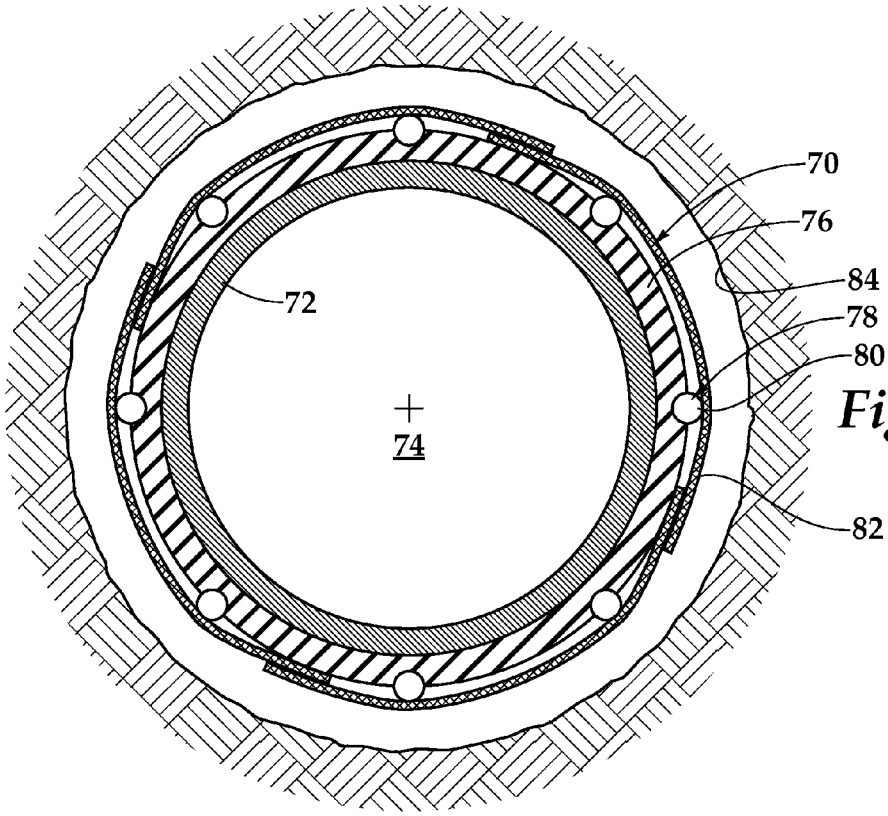
FIG. 4A is a cross sectional view of a sand control screen assembly in a running configuration according to an embodiment of the present invention.

Referring to FIG. 4A, therein is depicted a cross sectional view of a sand control screen assembly in its running configuration that embodies principles of the present invention and is generally designated 70. Sand control screen assembly 70 is similar in design to sand control screen 40 described above including a base pipe 72 that defines an internal flow path 74 and that includes a perforated longitudinal section and a blank pipe longitudinal section which is depicted in the cross section of FIG. 4A. Positioned around base pipe 72 is a swellable material layer 76. Swellable material layer 76 is attached to base pipe 72 by bonding or other suitable technique. Positioned around swellable material layer 76 is a fluid collection subassembly 78 that includes a plurality of perforated tubulars 80 that are circumferentially distributed about swellable material layer 76 and operate substantially in the manner described above with reference to fluid collection subassembly 50. Disposed around both swellable material layer 76 and fluid collection subassembly 78 is a screen element 82. Screen element 82 is attached to swellable material layer 76, base pipe 72 or both by bonding or other suitable technique. Screen element 82 may be used in conjunction with, in addition to or as an alternatively to other filter media such as filter medium 62 discussed above as well as the other types of filter media discussed herein including filter media disposed external to, internal to or downstream of fluid collection subassembly 78. In certain embodiments, screen element 82 may primarily serve as a drainage layer or a carrier for a chemical treatment or other agent, as discussed in greater detail below.

In the illustrated embodiment, screen element 82 is formed from a plurality of circumferential screen segments that overlap one another in the running configuration of sand control screen assembly 70. Even though screen element 82 has been depicted as including four segments, it should be understood by those skilled in the art that other numbers of segments both greater than and less than four, including one segment, could alternatively be used in keeping with the principles of the present invention.

Figure 4B:
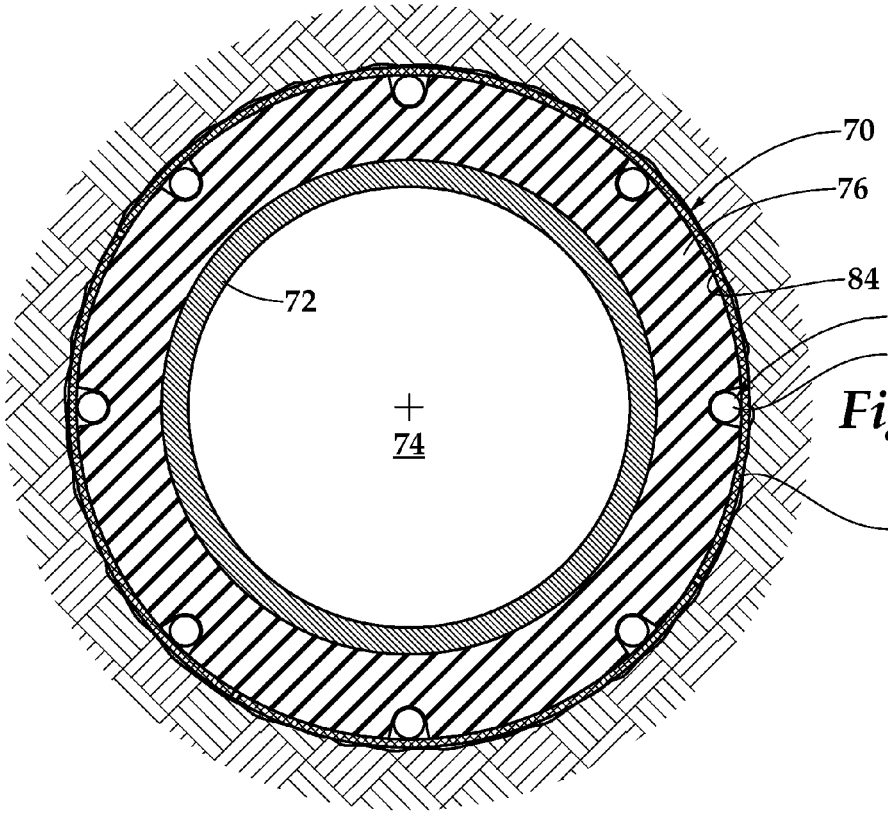
FIG. 4B is a cross sectional view of a sand control screen assembly in an operating configuration according to an embodiment of the present invention.

Referring additionally now to FIG. 4B, therein is depicted a cross sectional view of sand control screen assembly 70 in its operating configuration. In the illustrated embodiment, swellable material layer 76 has come in contact with an activating fluid, such as a hydrocarbon fluid, water or gas, which has caused swellable material layer 76 to radially expand placing screen element 82 into contact with the surface of wellbore 84. In addition to providing support to the formation to prevent formation collapse, in this embodiment, screen element 82 provides a stand off region between perforated tubulars 80 and wellbore 84. The use of this configuration is beneficial, for example, if a filter cake has previously formed on the surface of the formation, then the stand off will prevent damage to perforated tubulars 80 and allow removal of the filter cake using acid or other reactive substance.

Preferably, screen element 82 has the reactive substance impregnated therein. For example, the reactive substance may fill the voids in screen element 82 during installation. Preferably, the reactive substance is degradable when exposed to a subterranean well environment. More preferably, the reactive substance degrades when exposed to water at an elevated temperature in a well. Most preferably, the reactive substance is provided as described in U.S. Pat. No. 7,036,587 which is hereby incorporated by reference for all purposes.

In certain embodiments, the reactive substance includes a degradable polymer. Suitable examples of degradable polymers that may be used in accordance with the present invention include polysaccharides such as dextran or cellulose, chitins, chitosans, proteins, aliphatic polyesters, poly(lactides), poly(glycolides), poly(ϵ-caprolactones), poly(anhydrides), poly(hydroxybutyrates), aliphatic polycarbonates, poly(orthoesters), poly(amino acids), poly(ethylene oxides), and polyphosphazenes. Of these suitable polymers, aliphatic polyesters such as poly(lactide) or poly(lactic acid) and polyanhydrides are preferred.

The reactive substance may degrade in the presence of a hydrated organic or inorganic compound solid, which may be included in sand control screen assembly 70, so that a source of water is available in the well when the screens are installed. Alternatively, another water source may be delivered to the reactive substance after sand control screen assembly 70 is conveyed into the well, such as by circulating the water source down to the well or formation water may be used as the water source.

Figure 5:
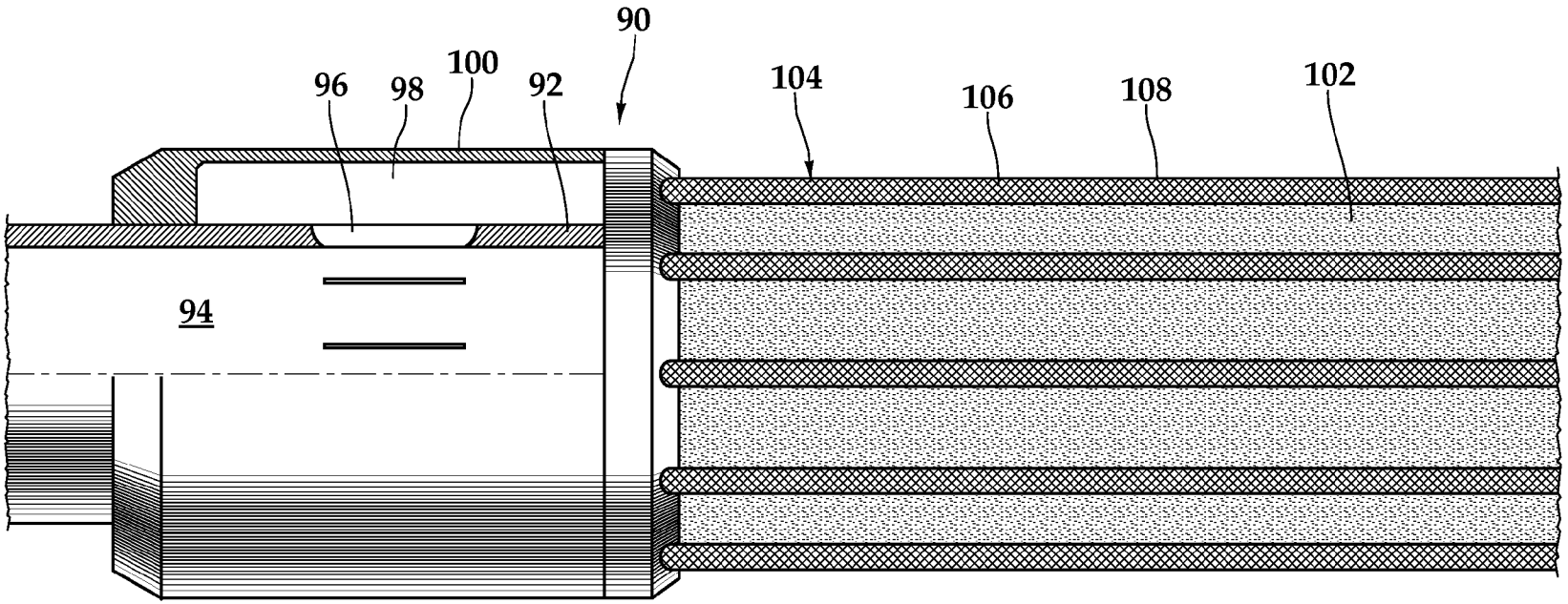
FIG. 5 is a side view partially in quarter section of a sand control screen assembly according to an embodiment of the present invention.

Referring to FIG. 5, therein is depicted a sand control screen assembly in its running configuration that embodies principles of the present invention and is generally designated 90. Sand control screen assembly 90 includes base pipe 92 that defines an internal flow path 94. Base pipe 92 has a plurality of openings 96 that allow fluid to pass to internal flow path 94 from an annular region 98 between base pipe 92 and outer housing 100. Positioned around a blank pipe section of base pipe 92 is a swellable material layer 102. Swellable material layer 102 is attached to base pipe 92 by bonding or other suitable technique. Disposed around swellable material layer 102 a fluid collection subassembly 104 that includes a plurality of perforated tubulars 106 that are circumferentially distributed about swellable material layer 102 and operate substantially in the manner described above with reference to fluid collection subassembly 104. In the illustrated embodiment, a filter medium 108 is positioned around each of the perforated tubulars 106. Filter medium 108 may include a wire wrap or one or more layers of wire or fiber mesh having various drainage layers and filtration layers as desired. This type of filter medium may be used in place of or in addition to a filter medium such as filter medium 62 or screen element 82 discussed above. Alternatively or additionally, filter materials could be placed inside of perforated tubulars 106. Such filter materials may include single or multiple layer sintered or unsintered mesh, steel or ceramic balls or beads that may be sintered in perforated tubulars 106, prepacked or resin coated sand, combinations of the above and the like.

In certain embodiments, it may be desirable to selectively allow and prevent flow through a sand control screen assembly of the present invention such as sand control screen assembly 90. In such embodiments, a valve or other flow control device may be placed in the fluid flow path between the exterior of sand control screen assembly 90 and internal flow path 94. For example, a sliding sleeve (not pictured) may be operably associated with base pipe 92 and openings 96. The sliding sleeve may be disposed internally of base pipe 92 within internal flow path 94 or may preferably be disposed externally of base pipe 92 within annular region 98. The sliding sleeve may have an open position wherein fluid flow through openings 96 is allowed and a closed position wherein fluid flow though openings 96 is prevented. In addition, the position of the sliding sleeve may be infinitely variable such that the sliding sleeve may provide a choking function. The sliding sleeve may be operated mechanically, electrically, hydraulically or by other suitable means.

Figure 6:
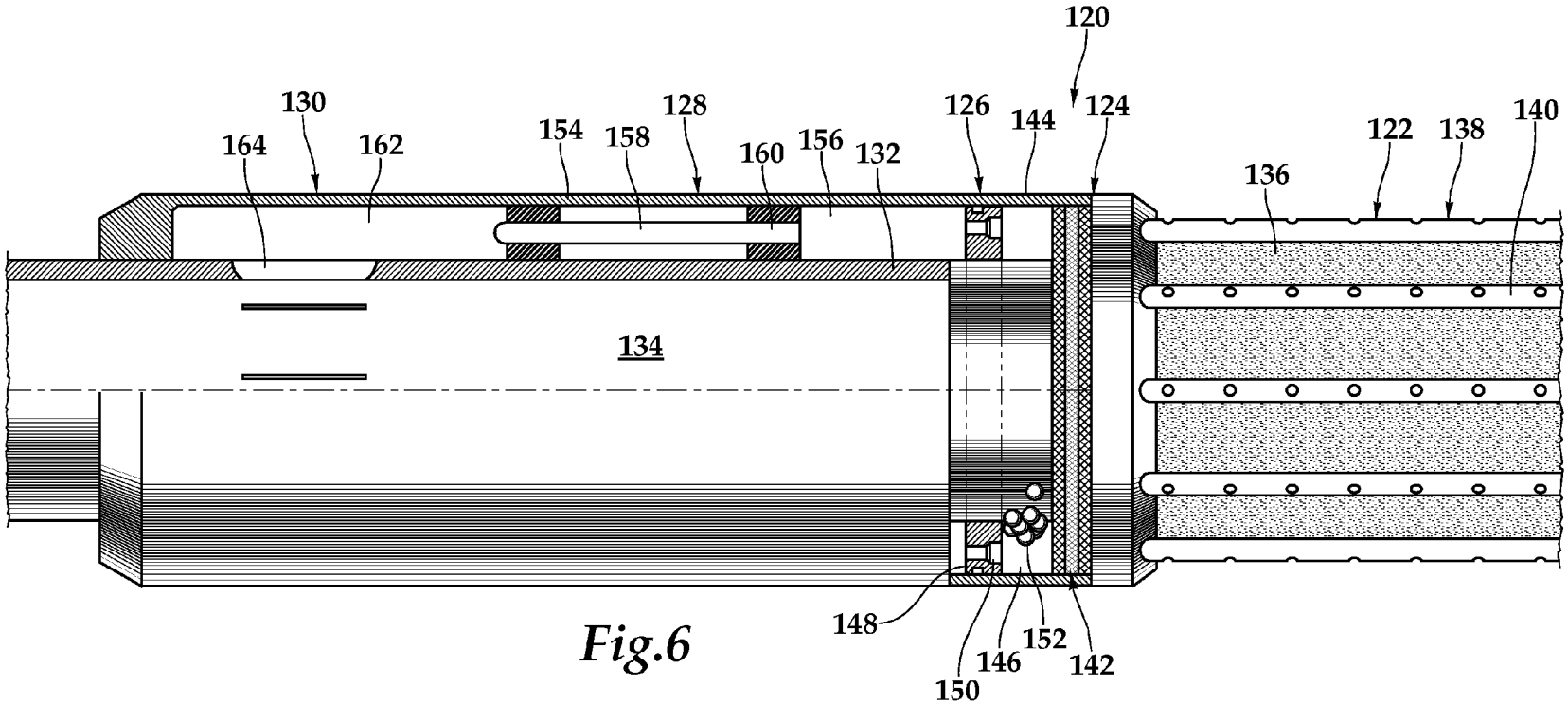
FIG. 6 is a side view partially in quarter section and partially in half section of a sand control screen assembly according to an embodiment of the present invention.

Referring next to FIG. 6, therein is depicted a sand control screen assembly in its running configuration that embodies principles of the present invention and is generally designated 120. Sand control screen assembly 120 includes a fluid collection section 122, sand control section 124, a fluid discriminator section 126, a flow restrictor section 128 and a fluid inlet section 130. Sand control screen assembly 120 includes a base pipe 132 that defines an internal flow path 134. In fluid collection section 122 of sand control screen assembly 120 a swellable material layer 136 is disposed around a blank pipe section of base pipe 132 and is attached thereto by bonding or other suitable technique. Disposed around swellable material layer 136 a fluid collection subassembly 138 that includes a plurality of perforated tubulars 140 that are circumferentially distributed about swellable material layer 136 and operate substantially in the manner described above with reference to fluid collection subassembly 50. Sand control section 124 includes a filter medium 142 that is illustrated as a multi-layer wire mesh filter medium including various drainage layers and filtration layers disposed in series.

Fluid discriminator section 126 is configured in series with sand control section 124 such that fluid must pass through sand control section 124 prior to entering fluid discriminator section 126. Fluid discriminator section 126 includes an outer housing 144 that defines an annular chamber 146 with a nonperforated section of base pipe 132. Fluid discriminator section 126 also includes retainer ring 148 that has a plurality of outlets 150 circumferentially spaced therein designed to provide a fluid passageway from chamber 146 to flow restrictor section 128.

One or more flow blocking members 152, depicted as spherical members or balls are disposed within chamber 146 between retainer ring 148 and filter medium 142, cooperate with outlets 150 to restrict the flow of any undesired portion of the production fluids that enter fluid discriminator section 126. For example, in the case of a production fluid containing both oil and water, the density of members 152 is such that certain of the outlets 150 are blocked by certain of the members 152 to shut off or choke the flow of water therethrough. Thus, when the production fluid is mainly oil, members 152 will be positioned relatively distant from outlets 150, for example, at the bottom of chamber 146. When a sufficient proportion of water is present in the production fluid, however, members 152 will restrict flow of the water by shutting off or choking flow through certain ones of the outlets 150.

Flow restrictor section 128 is configured in series with fluid discriminator section 126 such that fluid must pass through fluid discriminator section 126 prior to entering flow restrictor section 128. Flow restrictor section 128 includes an outer housing 154 that is suitably coupled to or integral with outer housing 144 of fluid discriminator section 126. Outer housing 154 defines an annular chamber 156 with a nonperforated section of base pipe 132. Disposed within chamber 156 is a flow rate controller 158. Flow rate controller 158 includes one or more tubular passageways 160 that provide a relative long, narrow and tortuous pathway for the fluids to travel within flow restrictor section 128 and that provide a more restrictive pathway than the unrestricted pathway through fluid discriminator section 126. As such, flow restrictor section 128 is operable to restrict the flow rate of the production fluids through sand control screen assembly 120.

Once the production fluids pass through flow rate controller 158 of flow restrictor section 128, they enter annular chamber 162 and eventually enter the interior flow path 134 of base pipe 132 via openings 164 which are depicted in the form of slots. Once inside base pipe 132, the production fluids flow to the surface within the tubing string.

Fluid discriminator section 126 is operable in various flow regimes and with various configurations of flow blocking members 152. For example, members 152 may have a single density and be designed to block a single type of undesirable fluid such as water or gas in an oil production operation, or may have two densities and be designed to block multiple types of undesirable fluids such as water and gas in an oil production operation. Also, all of the members intended to block a certain undesired fluid do not necessarily have the same density. Instead, the members in each category could have a range of different densities so that the members are neutrally buoyant in different densities of production fluids.

Even though FIG. 6 has described a particular embodiment of a fluid discriminator section, other types of fluid discriminating mechanisms can be used in association with the sand control screen assemblies of the present invention, such as those described in U.S. Pat. No. 7,185,706, and United States Application Publication Numbers US 2008-0041580 A1, US 2008-0041581 A1, US 2008-0041588 A1, and US 2008-0041582 A1, each of which is hereby incorporated by reference for all purposes. Likewise, even though FIG. 6 has described a particular embodiment of a flow restrictor section, other types of flow restricting mechanisms can be used in association with the sand control screen assemblies of the present invention, such as those described in U.S. Pat. Nos. 5,803,179, 6,857,476, 6,886,634, 6,899,176, 7,055,598, 7,096,945, and 7,191,833, and United States Application Publication Numbers US 2006-0042795 A1, US 2007-0039741 A1, US 2007-0246407 A1, US 2007-0246210 A1, and US 2007-0246213 A1, each of which is hereby incorporated by reference for all purposes.

Figure 7:
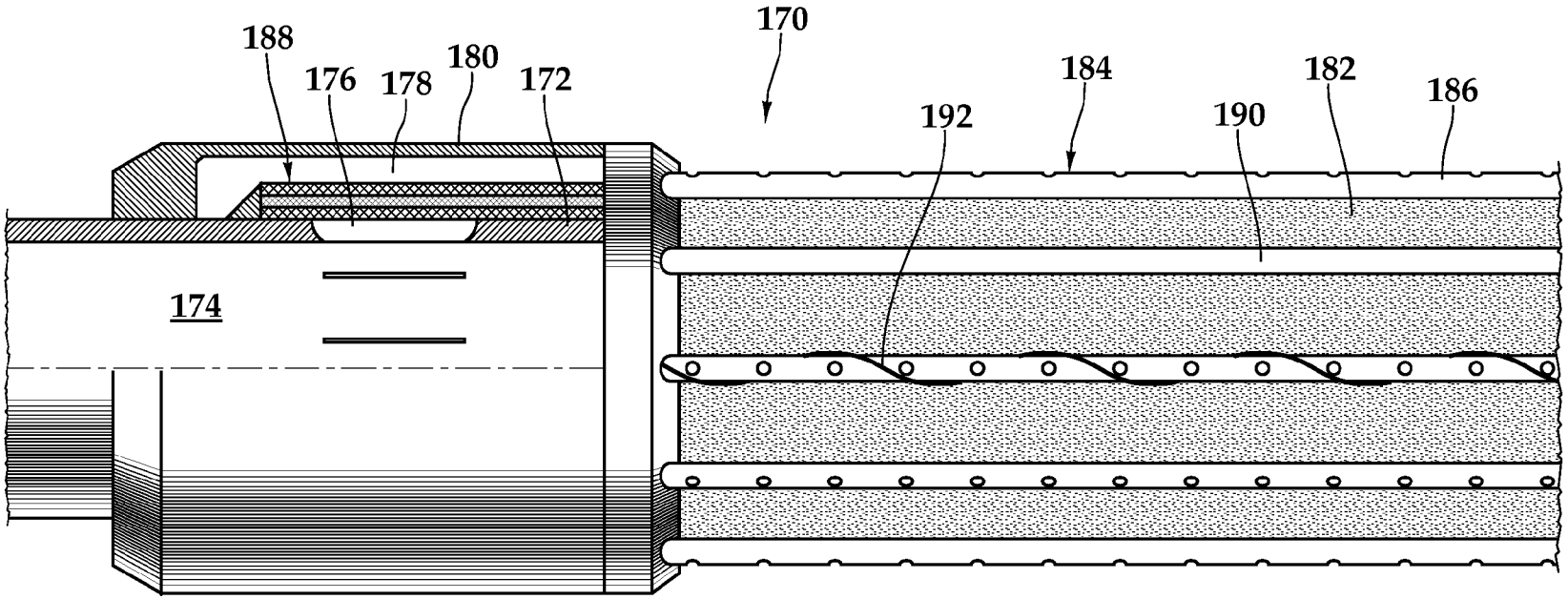
FIG. 7 is a side view partially in quarter section of a sand control screen assembly according to an embodiment of the present invention.

Referring to FIG. 7, therein is depicted a sand control screen assembly in its running configuration that embodies principles of the present invention and is generally designated 170. Sand control screen assembly 170 includes base pipe 172 that defines an internal flow path 174. Base pipe 172 has a plurality of openings 176 that allow fluid to enter internal flow path 174 from an annular region 178 between base pipe 172 and outer housing 180. Positioned around an unperforated portion of base pipe 172 is a swellable material layer 182. Swellable material layer 182 is attached to base pipe 172 by bonding or other suitable technique. Preferably, the thickness of swellable material layer 182 is optimized based upon the diameter of sand control screen assembly 170 and the diameter of the wellbore such that upon expansion, as described above, substantially uniform contact between both swellable material layer 182 and a fluid collection subassembly 184 with the surface of the wellbore is achieved.

Fluid collection subassembly 184 includes a plurality of perforated tubulars 186 that operate substantially in a manner as described above with reference to fluid collection subassembly 50. Preferably, perforated tubulars 186 are circumferentially distributed about the portion of sand control screen assembly 170 that includes swellable material layer 182. Disposed around the perforated portion of base pipe 172 and within annular region 178 is a filter medium 188. Filter medium 188 may comprise any suitable mechanical screening element or elements and is depicted as a multi-layer wire or fiber mesh screen designed to allow fluid flow therethrough but prevent the flow of particulate materials of a predetermined size from passing therethrough.

Fluid collection subassembly 184 of sand control screen assembly 170 also includes instrumentation and communication systems that allow information relating to the adjacent formation to be obtained and transmitted to the surface substantially in real time as desired. As illustrated, one of the perforated tubular 186 has been replaced with an electronics package 190 that includes one or more sensors. The sensors may be any one or more of the following types of sensors, including pressure sensors, temperature sensors, piezoelectric acoustic sensors, flow meters for determining flow rate, accelerometers, resistivity sensors for determining water content, velocity sensors, weight sensors or any other sensor that measures a fluid property or physical parameter downhole. As used herein, the term sensor shall include any of these sensors as well as any other types of sensors that are used in downhole environments and the equivalents to these sensors. For example, a fiber optic distributed temperature sensor 192 is depicted as being wrapped around one of the perforated tubular 186. The sensors may include or be associated with a microprocessor to allow manipulation and interpretation of the sensor data and for processing instructions. Likewise, the sensors may be coupled to a memory which provides for storing information for later batch processing or batch transmission, if desired. Importantly, this combination of components provides for localized control and operation of other downhole components such as an actuator which may be associated with a flow control device, a safety device or other actuatable downhole device. Alternatively or additionally, the sensor data may be digitally encoded and sent to the surface using electrical, optical, acoustic, electromagnetic or other telemetry techniques.

Figure 8A:
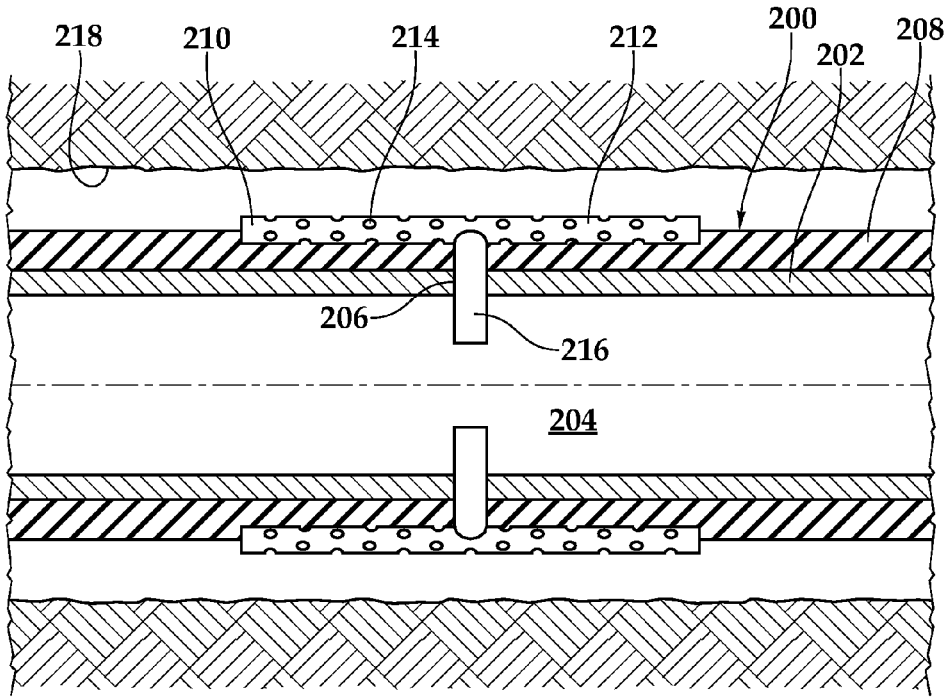
FIG. 8A is a cross sectional view of a sand control screen assembly in a running configuration according to an embodiment of the present invention.

Even though the sand control screen assemblies of the present have been described as having a fluid collection assembly that channels fluids into a fluid collecting annular chamber or manifold prior to entry into the internal flow path of the base pipe, those skilled in the art will recognize that other types of fluid collection techniques could alternatively be used. For example, as best seen in FIG. 8A, a sand control screen assembly in its running configuration that embodies principles of the present invention and is generally designated 200 is depicted. Sand control screen assembly 200 includes base pipe 202 that defines an internal flow path 204. Base pipe 202 has a plurality of openings 206. Positioned around base pipe 202 is a swellable material layer 208. Swellable material layer 208 is attached to base pipe 202 by bonding or other suitable technique. Sand control screen assembly 200 includes a fluid collection subassembly that is circumferentially distributed around swellable material layer 208 at one or more longitudinal locations and is depicted as a plurality of telescoping piston type fluid inlets 210. In the illustrated embodiment, each of the fluid inlets 210 including a tubular member 212 having a plurality of perforations 214. Proximate a center point of tubular member 212 is a discharge tube 216 that extends radially inwardly from tubular member 212 through an opening in swellable material layer 208 and opening 206 of base pipe 202. Fluid inlets 210 include a filter medium that is disposed within tubular member 212, discharge tube 216 or both. The filter medium may be single or multiple layer sintered or unsintered mesh, steel or ceramic balls or beads that may be sintered, prepacked or resin coated sand, combinations of the above and the like.

Figure 8B:
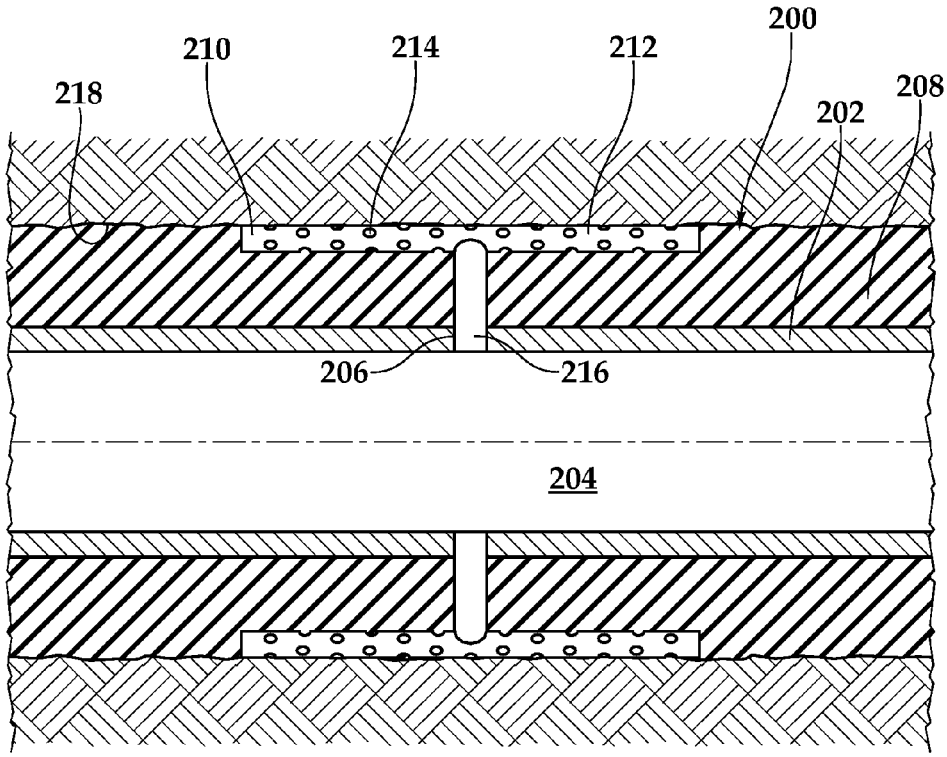
FIG. 8B is a cross sectional view of a sand control screen assembly in an operating configuration according to an embodiment of the present invention.

In a manner similar to that described above, sand control screen assembly 200 is run downhole with swellable material layer 208 in its unexpanded configuration. Upon contact with the activation fluid, such as a hydrocarbon fluid, water or gas as described herein, swellable material layer 208 is radially expanded, as best seen in FIG. 8B, such that the outer surface of swellable material layer 208 and tubular members 212 of fluid inlets 210 contact the surface of the open hole wellbore 218. As shown, when swellable material layer 208 is radially expanded, fluid inlets 210 are radially outwardly shifted in a piston-like manner. In addition to providing support to the formation to prevent formation collapse and placing the entry points for formations fluids in contact with the formation, in this embodiment, fluid inlets 210 provide a plurality of substantially direct paths for formation fluids to enter internal flow path 204 of base pipe 202.

Figure 9A:
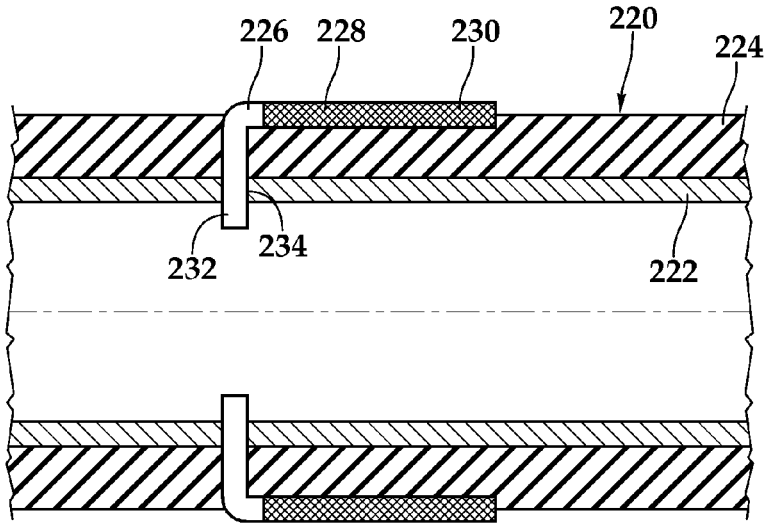
FIG. 9A is a cross sectional view of a sand control screen assembly according to an embodiment of the present invention.
Figure 9B:
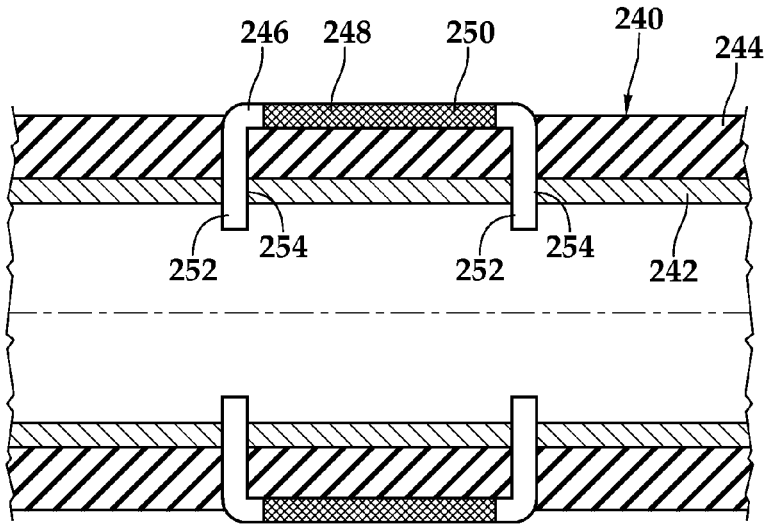
FIG. 9B is a cross sectional view of a sand control screen assembly according to an embodiment of the present invention.
Figure 9C:
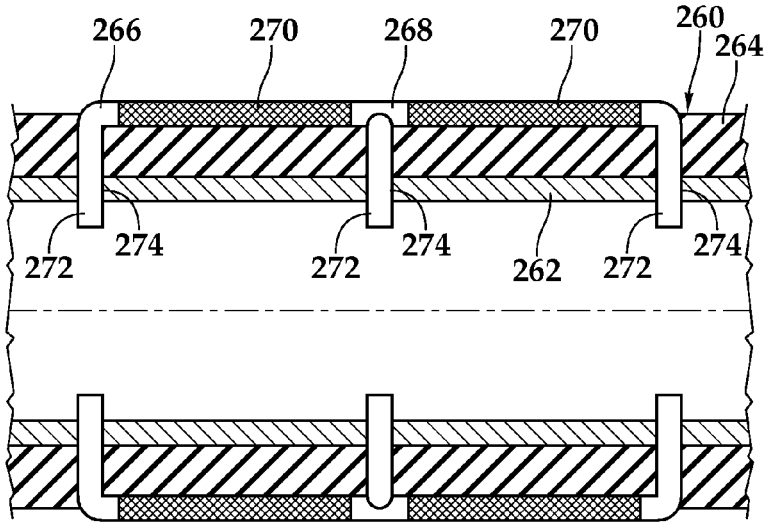
FIG. 9C is a cross sectional view of a sand control screen assembly according to an embodiment of the present invention.

Even though the sand control screen assembly 200 has been described as having fluid inlets 210 formed in the shape of a "T", those skilled in the art will recognize that other fluid inlets having other shapes could alternatively be used and would be considered within the scope of the present invention. For example, as best seen in FIG. 9A, a sand control screen assembly 220 that includes base pipe 222 and swellable material layer 224 has a plurality of telescoping piston type fluid inlets 226 formed in the shape of an "L". Specifically, fluid inlets 226 include a tubular member 228 having a plurality of perforations that are covered by a suitable filter medium 230 and a discharge tube 232 that extends radially inwardly from tubular member 228 through an opening in swellable material layer 224 and opening 234 of base pipe 222. Likewise, as best seen in FIG. 9B, a sand control screen assembly 240 that includes base pipe 242 and swellable material layer 244 has a plurality of telescoping piston type fluid inlets 246 formed in the shape of a "U". Specifically, fluid inlets 246 include a tubular member 248 having a plurality of perforations that are covered by a suitable filter medium 250 and a pair of discharge tubes 252 that extend radially inwardly from tubular member 248 through openings in swellable material layer 244 and a pair of opening 254 of base pipe 242. Further, as best seen in FIG. 9C, a sand control screen assembly 260 that includes base pipe 262 and swellable material layer 264 has a plurality of telescoping piston type fluid inlets 266 formed in the shape of an "M". Specifically, fluid inlets 266 include a tubular member 268 having a plurality of perforations that are covered by a pair of suitable filter media 270 and three discharge tubes 272 that extends radially inwardly from tubular member 268 through openings in swellable material layer 264 and openings 274 of base pipe 262. Accordingly, it can be seen that fluid inlets that provide one or more direct paths for formation fluids to enter an internal flow path of a base pipe can take many shapes or configurations, each of which are considered to be within the scope of the present invention.

Figure 10A:
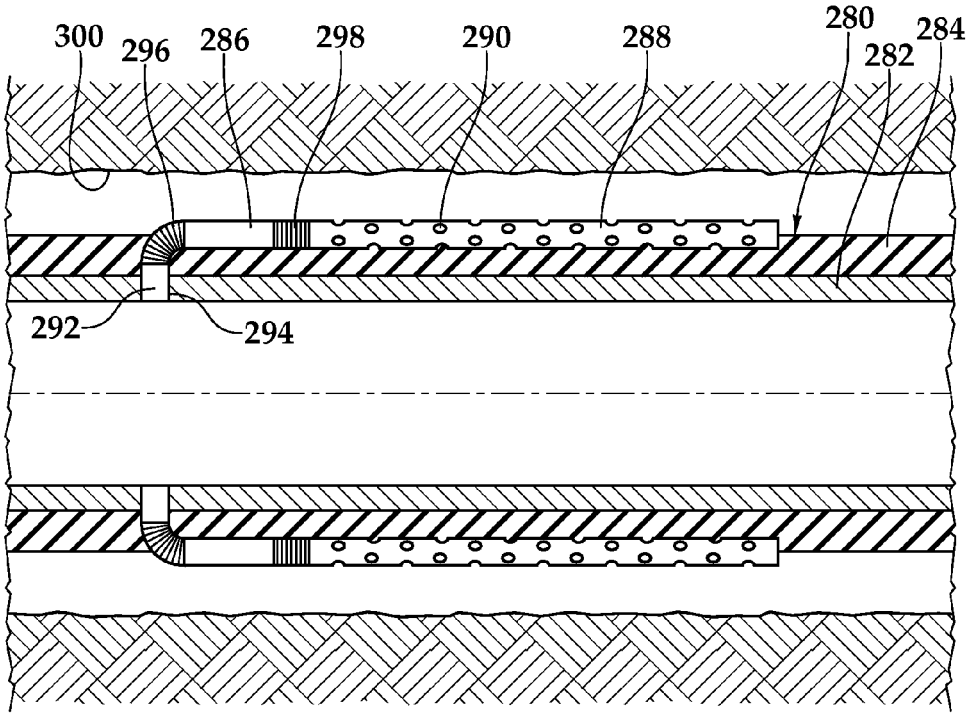
FIG. 10A is a cross sectional view of a sand control screen assembly in a running configuration according to an embodiment of the present invention.
Figure 10B:
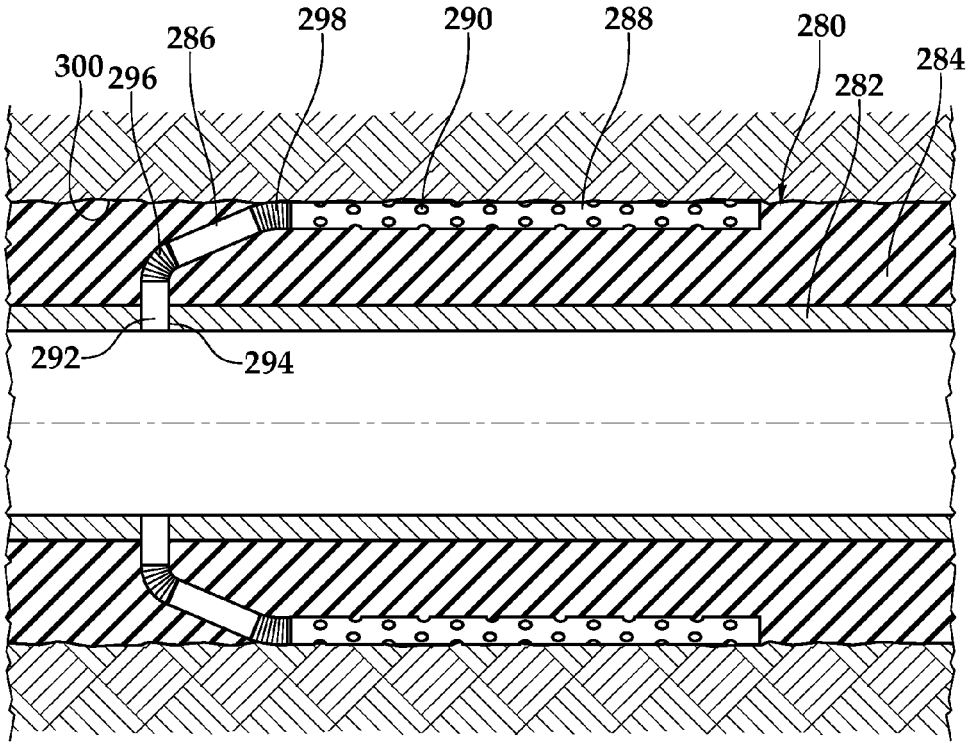
FIG. 10B is a cross sectional view of a sand control screen assembly in an operating configuration according to an embodiment of the present invention.

Even though the sand control screen assemblies 200, 220, 240, 260 have been described as having fluid inlets that radially outward shift in a piston-like manner, those skilled in the art will recognize that other techniques may be used to radially extend fluid inlets which would be considered within the scope of the present invention. For example, as best seen in FIG. 10A, a sand control screen assembly 280 that includes base pipe 282 and swellable material layer 284 has a plurality of flexible fluid inlets 286 formed in the shape of an "L" in the running configuration. Fluid inlets 286 include a tubular member 288 having a plurality of perforations 290 and a discharge tube 292 that extends radially inwardly from tubular member 288 through an opening in swellable material layer 284 and opening 294 of base pipe 282. A filter medium of a type discussed above may be disposed within tubular member 288, discharge tube 292 or both. Fluid inlets 286 also include a pair flexible joints 296, 298 which enhance the ability of tubular member 288 to contact the wellbore 300 when swellable material layer 284 is activated, as best seen in FIG. 10B.

Figure 11:
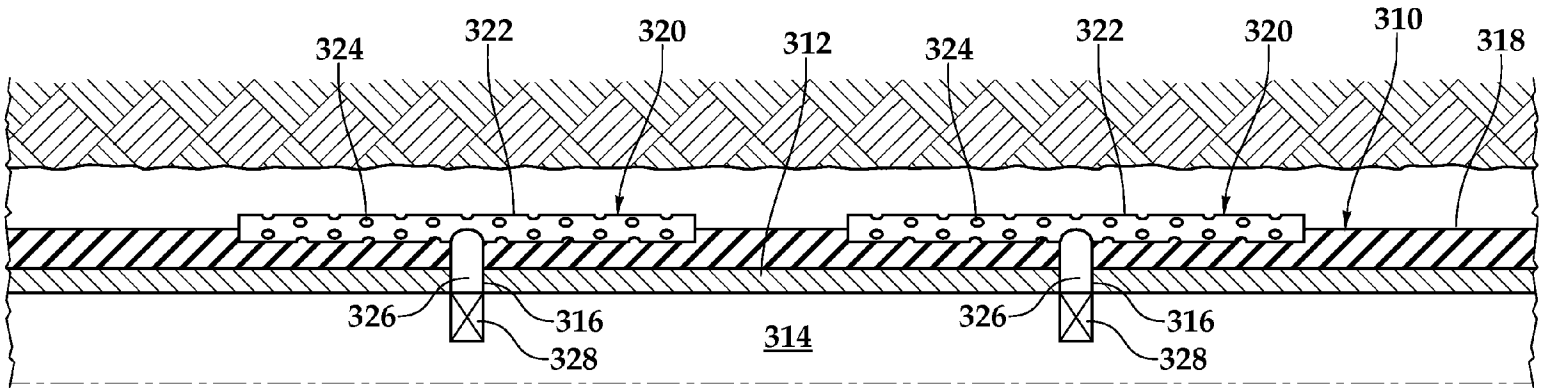
FIG. 11 is a cross sectional view of a sand control screen assembly according to an embodiment of the present invention.

Referring next to FIG. 11, therein is depicted a sand control screen assembly in its running configuration that embodies principles of the present invention and is generally designated 310. Sand control screen assembly 310 includes base pipe 312 that defines an internal flow path 314. Base pipe 312 has a plurality of openings 316. Positioned around base pipe 312 is a swellable material layer 318. Swellable material layer 318 is attached to base pipe 312 by bonding or other suitable technique. Sand control screen assembly 310 includes a fluid collection subassembly that is circumferentially distributed around swellable material layer 318 at one or more longitudinal locations and is depicted as a plurality of telescoping piston type fluid inlets 320. In the illustrated embodiment, each of the fluid inlets 320 including a tubular member 322 having a plurality of perforations 324. Proximate a center point of each tubular member 322 is a discharge tube 326 that extends radially inwardly from tubular member 322 through an opening in swellable material layer 318 and one of the openings 316 of base pipe 312. Fluid inlets 320 include a filter medium that is disposed within tubular member 322, discharge tube 326 or both. The filter medium may be any of the filter media discussed herein including a single or multiple layer sintered or unsintered mesh, steel or ceramic balls or beads that may be sintered, prepacked or resin coated sand, combinations of the above and the like.

Each fluid inlet 320 also includes a fluid flow control device 328 that is disposed within discharge tube 326. Depending upon the desired operation, fluid flow control device 328 may take a variety of forms. For example, it may be desirable to temporarily prevent fluid flow through fluid inlets 320. In this case, fluid flow control device 328 may be a dissolvable, removable or shearable plug formed from sand, salt, wax, aluminum, zinc or the like or may be a pressure activated device such as burst disk. As another example, it may be desirable to prevent fluid loss into the formation during high pressure operations internal to sand control screen assembly 310 in which case, fluid flow control device 328 may be a one-way valve or a check valve. In a further example, it may be desirable to control the rate of production into sand control screen assembly 310 in which case, fluid flow control device 328 may be an inflow control device such as a nozzle, a flow tube, an orifice or other flow restrictor. As yet another example, it may be desirable to control the type of fluid entering sand control screen assembly 310 in which case, fluid flow control device 328 may be a production control device such as a valve that closes responsive to contact with an undesired fluid, such as water. Such valves may be actuated by a swellable material including those discussed above, organic fibers, an osmotic cell or the like.

Figure 12:
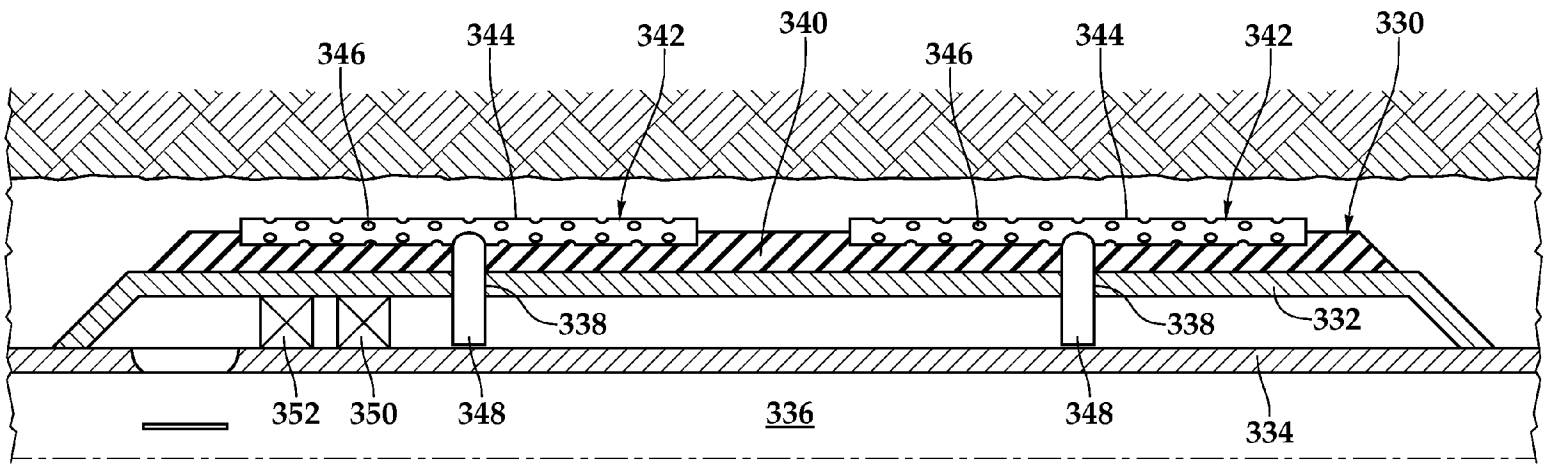
FIG. 12 is a cross sectional view of a sand control screen assembly according to an embodiment of the present invention.

Referring next to FIG. 12, therein is depicted a sand control screen assembly in its running configuration that embodies principles of the present invention and is generally designated 330. Sand control screen assembly 330 includes base pipe 332 and an inner sleeve 334 that defines an internal flow path 336. Base pipe 332 has a plurality of openings 338. Positioned around base pipe 332 is a swellable material layer 340. Swellable material layer 340 is attached to base pipe 332 by bonding or other suitable technique. Sand control screen assembly 330 includes a fluid collection subassembly that is circumferentially distributed around swellable material layer 340 at one or more longitudinal locations and is depicted as a plurality of telescoping piston type fluid inlets 342. In the illustrated embodiment, each of the fluid inlets 342 including a tubular member 344 having a plurality of perforations 346. Proximate a center point of each tubular member 344 is a discharge tube 348 that extends radially inwardly from tubular member 344 through an opening in swellable material layer 340 and one of the openings 338 of base pipe 332. Fluid inlets 342 include a filter medium that is disposed within tubular member 344, discharge tube 348 or both. The filter medium may be any of the filter media discussed herein including a single or multiple layer sintered or unsintered mesh, steel or ceramic balls or beads that may be sintered, prepacked or resin coated sand, combinations of the above and the like.

Disposed between base pipe 332 and sleeve 334 is a pair of fluid flow control devices 350, 352. As described above, depending upon the desired operation, fluid flow control devices 350, 352 may take a variety of forms including in any combination of dissolvable, removable or shearable plugs, a burst disk, a one-way valve, a check valve, a nozzle, a flow tube, an orifice or other flow restrictor, a valve that closes responsive to contact with an undesired fluid and the like. In certain embodiments, sleeve 334 is removable by mechanical or chemical means such that the operation of fluid flow control devices 350, 352 can be disabled if desired.

Figure 13A:
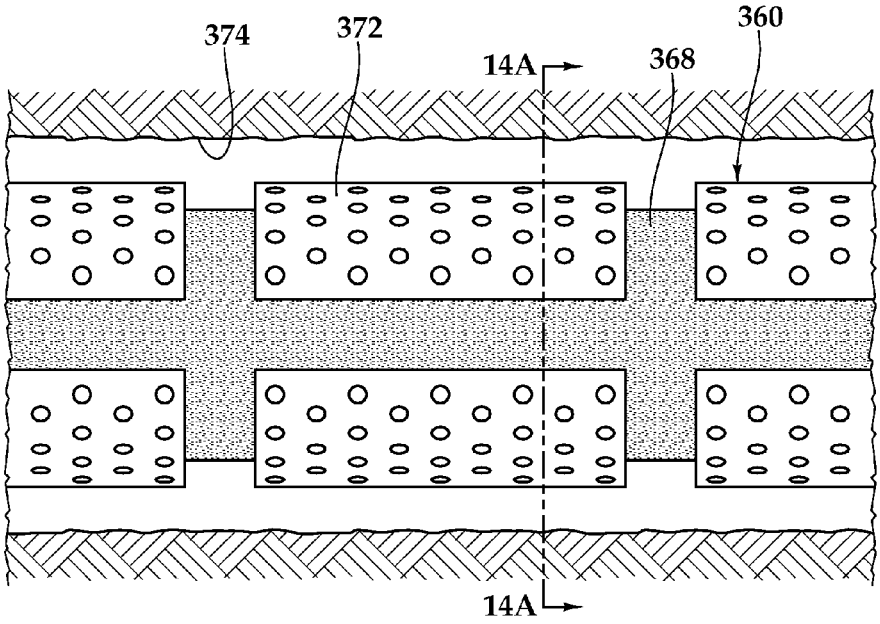
FIG. 13A is a side view of a sand control screen assembly in a running configuration according to an embodiment of the present invention.
Figure 13B:
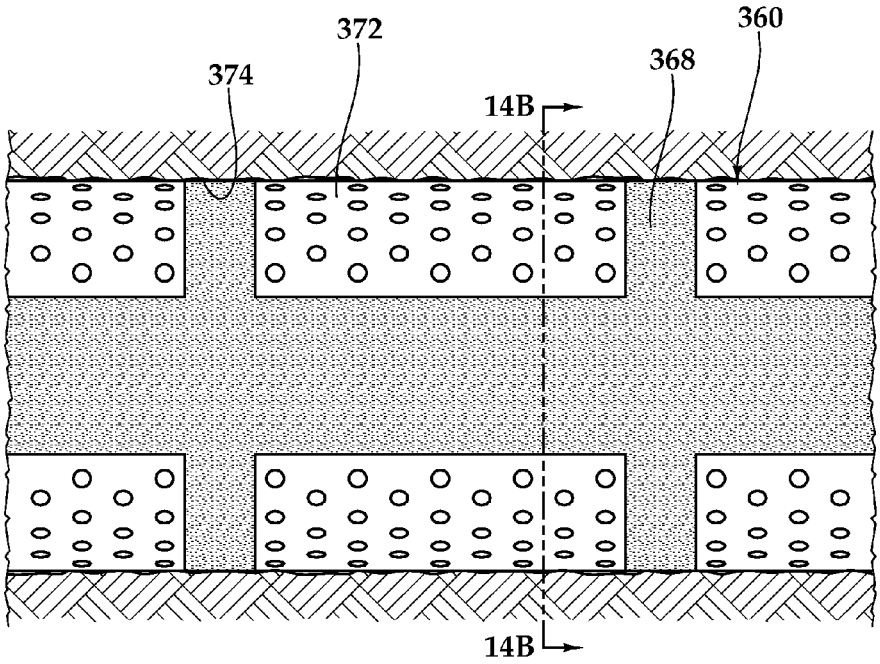
FIG. 13B is a side view of a sand control screen assembly in an operating configuration according to an embodiment of the present invention.
Figure 14A:
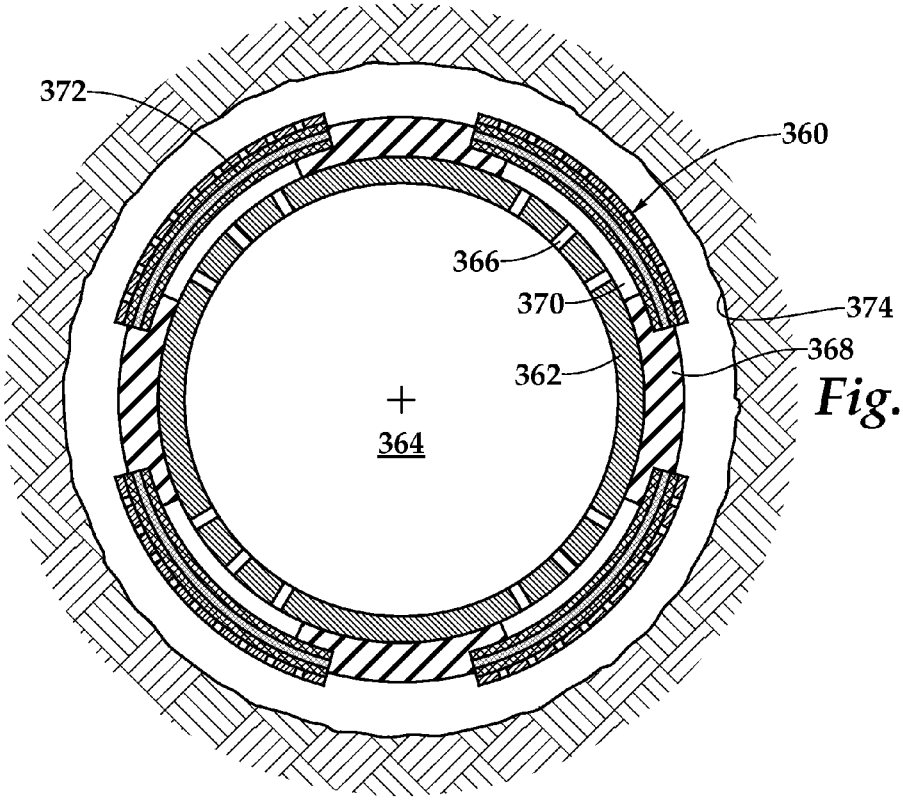
FIG. 14A is a cross sectional view taken along line 14A-14A of a sand control screen assembly of FIG. 13A in a running configuration according to an embodiment of the present invention.
Figure 14B:
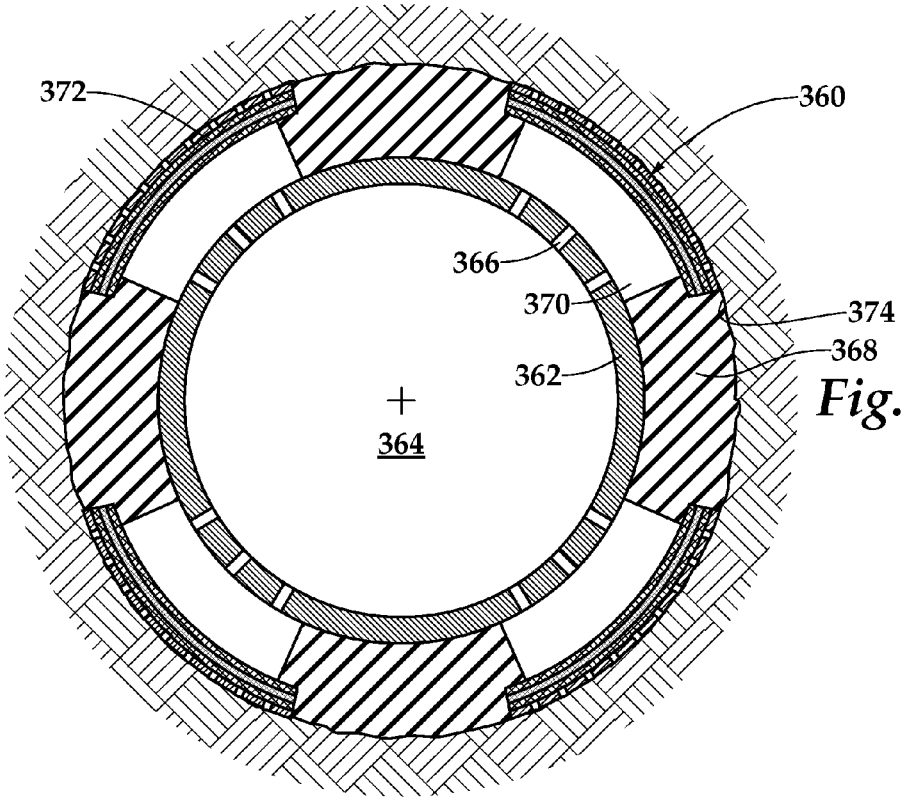
FIG. 14B is a cross sectional view taken along line 14B-14B of a sand control screen assembly of FIG. 13B in an operating configuration according to an embodiment of the present invention.

Referring to FIG. 13A, therein is depicted a sand control screen assembly in its running configuration that embodies principles of the present invention and is generally designated 360. Sand control screen assembly 360 includes base pipe 362, as best seen in FIG. 14A, that defines an internal flow path 364. Base pipe 362 has a plurality of openings 366 that allow fluid to pass between the exterior of base pipe 362 and internal flow path 364. Positioned around base pipe 362 is a swellable material layer 368. Swellable material layer 368 is attached to base pipe 362 by bonding or other suitable technique. Swellable material layer 368 has a plurality of openings 370 that allows fluid produced through screen sections 372 to enter internal flow path 364. Screen sections 372 may be formed from a variety of filter media as discussed herein and are illustrated as having a plurality of layers of wire or fiber mesh including drainage layers and filtration layers as well as a perforated outer shroud. Preferably, the thickness of swellable material layer 368 is optimized based upon the diameter of sand control screen assembly 360 and the diameter of wellbore 374 such that upon expansion, as explained above, substantially uniform contact between both swellable material layer 368 and screen sections 372 with the surface of wellbore 374 is achieved, as best seen in FIGS. 13B and 14B.

In addition to providing a path for formation fluids to enter internal flow path, sand control screen assembly 360 provides support to formation to prevent formation collapse. Specifically, the shape and configuration of screen sections 372 makes the outer surface of sand control screen assembly 360 particularly compliant which improves the contact between sand control screen assembly 360 and the formation upon radial expansion of swellable material layer 368.

Figure 15A:
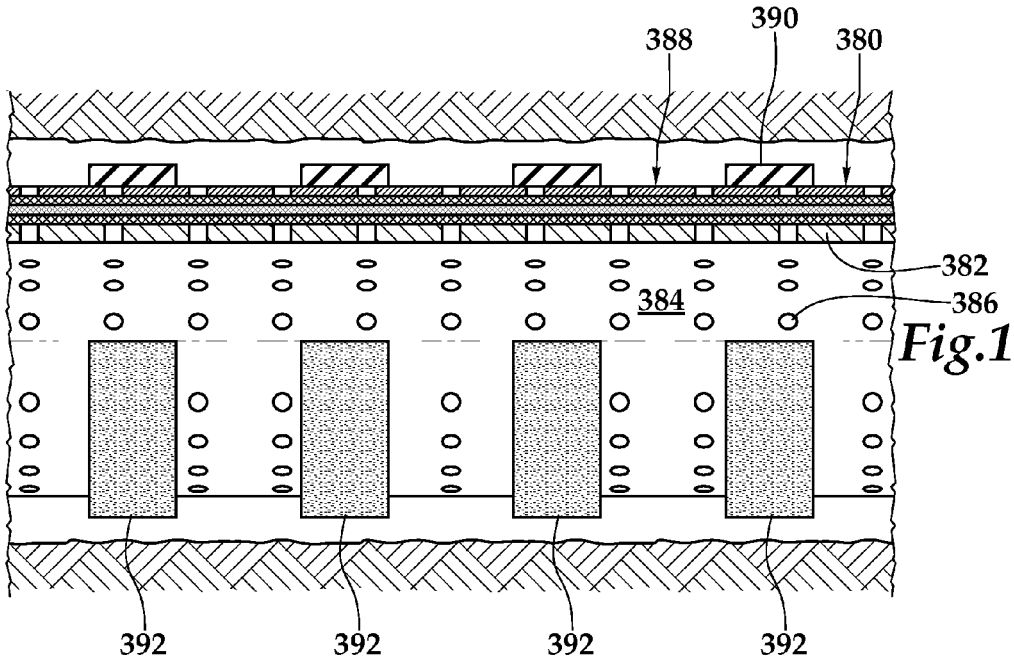
FIG. 15A is a quarter sectional view of a sand control screen assembly in a running configuration according to an embodiment of the present invention.
Figure 15B:
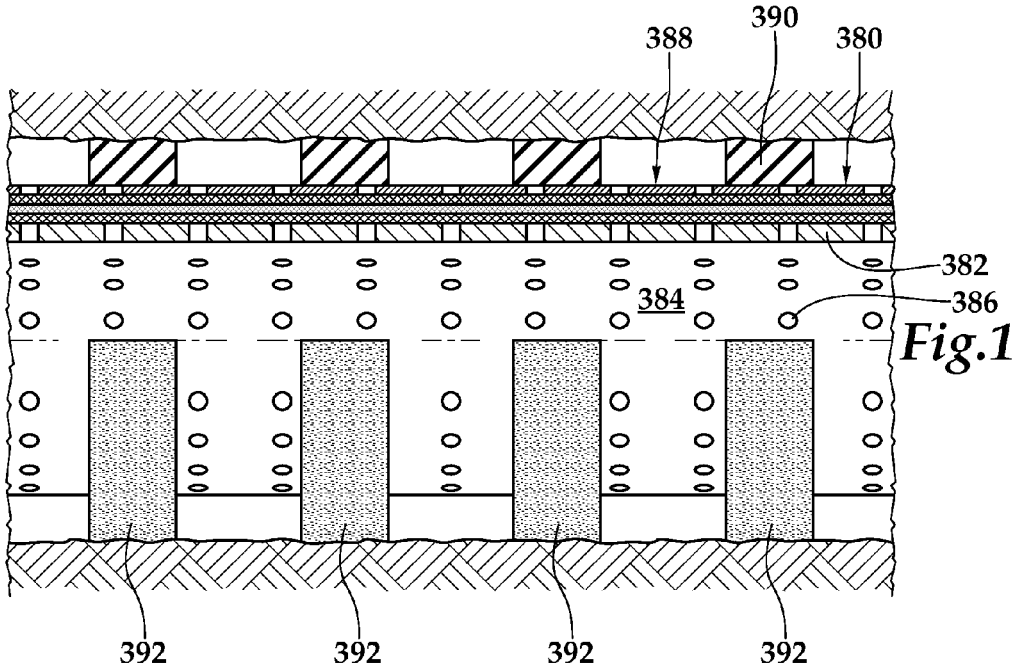
FIG. 15B is a quarter sectional view of a sand control screen assembly in an operating configuration according to an embodiment of the present invention.

Referring to FIG. 15A, therein is depicted a sand control screen assembly in its running configuration that embodies principles of the present invention and is generally designated 380. Sand control screen assembly 380 includes a base pipe 382 that defines an internal flow path 384 and a plurality of openings 386 that allow fluid to pass between the exterior of base pipe 382 and internal flow path 384. Disposed around base pipe 382 is a filter medium 388. As illustrated, filter medium 388 includes an outer perforated shroud, outer and inner drainage layers that have a relative course wire mesh with a filtration layer disposed therebetween having a relatively fine mesh. Positioned around base pipe 382 is a swellable material layer 390. Swellable material layer 390 is attached to filter medium 388 by bonding or other suitable technique. As illustrated, swellable material layer 390 includes a plurality of bands 392 that extend circumferentially around 360 degrees of base pipe 382. In this configuration, swellable material layer 390 provides isolation completely around multiple sections of filter medium 388 upon activation of swellable material layer 390, as best seen in FIG. 15B, which places swellable material layer 390 in contact with the formation. In this configuration, the use of packers or other sealing devices in conjunction with one or more sand control screen assemblies 380 may be reduced or eliminated.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly operably positionable within a wellbore, the sand control screen assembly comprising:

a base pipe having at least one opening in a sidewall portion thereof and an internal flow path;

a swellable material layer disposed exteriorly of at least a portion of the base pipe;

a fluid collection subassembly disposed exteriorly of the swellable material layer and in fluid communication with the internal flow path via the opening; and a drainage layer disposed exteriorly of the fluid collection subassembly and the swellable material layer;

wherein, in response to contact with an activating fluid, radial expansion of the swellable material layer causes at least a portion of the fluid collection subassembly and the drainage layer to be displaced toward a surface of the wellbore.

2. The sand control screen assembly as recited in claim 1 wherein the swellable material layer is disposed exteriorly of a blank pipe section of the base pipe.

3. The sand control screen assembly as recited in claim 1 wherein the fluid collection subassembly further comprises a plurality of circumferentially distributed perforated tubulars.

4. The sand control screen assembly as recited in claim 1 further comprising a filter medium operably associated with the sand control screen assembly and disposed in a fluid path between the exterior of the sand control screen assembly and the internal flow path.

5. The sand control screen assembly as recited in claim 4 wherein the filter medium is disposed internal to the fluid collection subassembly.

6. The sand control screen assembly as recited in claim 4 wherein the filter medium is disposed downstream of the fluid collection subassembly.

7. The sand control screen assembly as recited in claim 1 wherein the activating fluid is at least one of a hydrocarbon fluid, water and gas.

8. The sand control screen assembly as recited in claim 1 wherein, in response to contact with the activating fluid, radial expansion of the swellable material layer causes at least a portion of the drainage layer to contact the wellbore.

9. The sand control screen assembly as recited in claim 8 wherein the drainage layer provides a stand off region between the fluid collection subassembly and the wellbore.

10. The sand control screen assembly as recited in claim 1 wherein the drainage layer further comprises a plurality of circumferential drainage layer segments.

11. The sand control screen assembly as recited in claim 1 wherein an additive is carried within the drainage layer.

12. The sand control screen assembly as recited in claim 11 wherein the additive further comprises a reactive substance.

13. The sand control screen assembly as recited in claim 11 wherein the additive further comprises a degradable polymer selected from the group consisting of polysaccharides, dextran, cellulose, chitins, chitosans, proteins, aliphatic polyesters, poly(lactides), poly(glycolides), poly(e-caprolactones), poly(anhydrides), poly(hydroxybutyrates), aliphatic polycarbonates, poly(orthoesters), poly(amino acids), poly(ethylene oxides) and polyphosphazenes.

14. The sand control screen assembly as recited in claim 11 wherein the additive is selected from the group consisting of aliphatic polyesters, poly(lactides), poly(lactic acids) and poly(anhydrides).

15. A method of installing a sand control screen assembly in a wellbore, the method comprising:

running the sand control screen assembly to a target location within the wellbore, the sand control screen assembly having a base pipe, a swellable material layer disposed exteriorly of at least a portion of a base pipe, a fluid collection subassembly disposed exteriorly of the swellable material layer and a drainage layer disposed exteriorly of the fluid collection subassembly and the swellable material layer;

contacting the swellable material layer with an activating fluid;

radially expanding the swellable material layer in response to contact with the activating fluid; and displacing at least a portion of the fluid collection subassembly and the drainage layer toward a surface of the wellbore in response to the radial expansion of the swellable material layer.

16. The method as recited in claim 15 wherein radially expanding the swellable material layer in response to contact with the activating fluid further comprises contacting the swellable material layer with at least one of a hydrocarbon fluid, water and gas.

17. The method as recited in claim 15 wherein displacing at least a portion of the fluid collection subassembly and the drainage layer toward a surface of the wellbore in response to the radial expansion of the swellable material layer further comprises placing at least a portion of the drainage layer in contact with the wellbore in response to the radial expansion of the swellable material layer.

18. The method as recited in claim 17 wherein placing at least a portion of the drainage layer in contact with the wellbore further comprises establishing a stand off region between the fluid collection subassembly and the wellbore.

19. The method as recited in claim 15 wherein displacing the drainage layer toward a surface of the wellbore in response to the radial expansion of the swellable material layer further comprises displacing a plurality of circumferential drainage layer segments toward the surface of the wellbore.

20. The method as recited in claim 15 further comprising carrying an additive within the drainage layer.

21. The method as recited in claim 20 wherein carrying an additive within the drainage layer further comprises carrying a reactive substance within the drainage layer.

22. The method as recited in claim 20 wherein carrying an additive within the drainage layer further comprises carrying an additive selected from the group consisting of aliphatic polyesters, poly(lactides), poly(lactic acids) and poly(anhydrides) within the drainage layer.

23. The method as recited in claim 20 wherein carrying an additive within the drainage layer further comprises carrying a degradable polymer selected from the group consisting of polysaccharides, dextran, cellulose, chitins, chitosans, proteins, aliphatic polyesters, poly(lactides), poly(glycolides), poly(e-caprolactones), poly(anhydrides), poly(hydroxybutyrates), aliphatic polycarbonates, poly(orthoesters), poly (amino acids), poly(ethylene oxides) and polyphosphazenes within the drainage layer.

* * * * *